US012006786B2

(12) United States Patent
Laun

(10) Patent No.: US 12,006,786 B2
(45) Date of Patent: Jun. 11, 2024

(54) MODIFIED CASING BUOYANCY SYSTEM AND METHODS OF USE

(71) Applicant: Canadian Casing Accessories Inc., Calgary (CA)

(72) Inventor: Lyle Laun, Calgary (CA)

(73) Assignee: Canadian Casing Accessories, Inc., Calgary (CA)

( * ) Notice: Subject to any disclaimer, the term of this patent is extended or adjusted under 35 U.S.C. 154(b) by 88 days.

(21) Appl. No.: 17/717,435

(22) Filed: Apr. 11, 2022

(65) Prior Publication Data

US 2022/0333458 A1 Oct. 20, 2022

Related U.S. Application Data

(60) Provisional application No. 63/286,745, filed on Dec. 7, 2021, provisional application No. 63/175,169, filed on Apr. 15, 2021.

(51) Int. Cl.
*E21B 34/06* (2006.01)
*E21B 23/00* (2006.01)

(52) U.S. Cl.
CPC ..... *E21B 34/063* (2013.01); *E21B 23/00* (2013.01); *E21B 2200/08* (2020.05)

(58) Field of Classification Search
CPC ..... E21B 34/063; E21B 23/00; E21B 2200/08
See application file for complete search history.

(56) References Cited

U.S. PATENT DOCUMENTS 3,180,420 A * 4/1965 Manson, Jr. ..... E21B 33/1294 137/454.2
4,986,361 A * 1/1991 Mueller ..... E21B 23/08 166/381
5,117,915 A * 6/1992 Mueller ..... E21B 23/00 166/381
5,318,118 A * 6/1994 Duell ..... E21B 34/14 166/318
5,479,986 A * 1/1996 Gano ..... E21B 34/10 166/292
5,685,372 A * 11/1997 Gano ..... E21B 34/102 166/292
5,829,526 A * 11/1998 Rogers ..... E21B 21/10 166/291
6,056,053 A * 5/2000 Giroux ..... E21B 33/167 166/155
6,119,783 A * 9/2000 Parker ..... E21B 34/10 166/135
6,622,798 B1 * 9/2003 Rogers ..... E21B 33/14 166/380
6,739,398 B1 * 5/2004 Yokley ..... E21B 23/04 166/123

(Continued)

*Primary Examiner* — Steven A MacDonald
(74) *Attorney, Agent, or Firm* — Russell Manning; FisherBroyles, LLP

(57) ABSTRACT

According to embodiments, a modified casing buoyancy system is provided for use as either one or both a casing buoyancy tool during casing operations and a cement plug during cementing operations, the apparatus being operably connected to a casing string and having at least two tubulars, wherein a portion of at least one (outer) tubular comprises at least one connector for controllably releasing said tubular downhole, and at least a portion of the other (inner) tubular comprises a dissolvable portion for controllably degrading thereof.

7 Claims, 27 Drawing Sheets

(56) References Cited

U.S. PATENT DOCUMENTS

| | | | | |
|---|---|---|---|---|
| 7,726,406 | B2 * | 6/2010 | Xu | E21B 23/00 166/381 |
| 8,297,364 | B2 * | 10/2012 | Agrawal | E21B 43/112 166/376 |
| 10,316,626 | B2 * | 6/2019 | Keshishian | E21B 43/10 |
| 10,808,490 | B2 * | 10/2020 | Giroux | E21B 43/10 |
| 10,883,333 | B2 * | 1/2021 | Giroux | E21B 47/06 |
| 11,313,199 | B2 * | 4/2022 | Saraya | E21B 34/14 |
| 2016/0333658 | A1 * | 11/2016 | Keshishian | E21B 37/10 |

* cited by examiner

MODIFIED CASING BUOYANCY SYSTEM AND METHODS OF USE

CROSS REFERENCE TO RELATED APPLICATIONS

This application claims the benefit of priority to U.S. Provisional Patent Application Nos. 63/175,169 filed Apr. 15, 2021 and 63/286,745 filed Dec. 7, 2021 both entitled "Modified Casing Buoyancy System and Methods of Use", which are specifically incorporated by reference herein for all that it discloses or teaches.

FIELD

Embodiments herein are generally related to apparatus for use in the oil and gas industry, and more particularly to an improved casing buoyancy system for use during casing operations.

BACKGROUND

Various tools and methods are required for the completion of subterranean wellbores penetrating a formation for the purpose of recovering hydrocarbons. Wellbores are drilled into the formation using any suitable drilling technique and extend substantially downwardly away from the earth's surface over both vertical and horizontal (lateral) wellbore portions. Once drilled, at least a portion of the wellbore is lined with casing that is run in hole, known as casing operations, and then secured into position against the formation using cement, known as cementing operations. These operations involve running a string of cylindrical pipe connected end-to-end into the wellbore, the pipe forming a continuous casing 'string' or liner that supports the wellbore wall and provides access to the formation. When the casing string lands in its desired position, referred to as 'casing on bottom', the string is secured in place using cement that is pumped downhole through the string and into the annulus where it solidifies between the string and the wellbore wall. At least a portion of the casing string and/or wellbore may also be punctured to provide access to the formation for the distribution of treatment fluids and other materials, known as fracing operations.

Wellbore geometries commonly include doglegs, excessive turns, bends, or formation cuttings that can adversely impact running casing string downhole. Difficulties running the casing string to depth can also arise in extended reach wellbore situations where, for example, the horizontal portion of the wellbore is longer than the vertical and curved portions of the wellbore. These difficulties arise because the overall or cumulative mass of the casing string (e.g., hook load) in the vertical portion of the well is not large enough to overcome the frictional drag forces due to the doglegs, formation cuttings, and the casing in the lateral portion of the well. In addition, as the length of the casing entering the lateral portion of the well increases, the frictional drag force increases, resisting downward forces until it prohibits any further movement of the casing string before it arrives at the desired depth.

Many attempts have been made to overcome drag forces arising during casing operations, such attempts typically being focused on either overcoming or decreasing the coefficient of friction between casing and wellbore. Some attempts have involved the use of an inverted casing string, whereby heavy casing string was run in the vertical section of the wellbore to provide additional weight. This method attempts to overcome drag forces rather than to reduce them. However, if drag forces are high enough, the lower end of the casing can buckle. That is, the added downward force can highly compress the casing string an cause the casing to distort (adding further drag forces), or to cause structural failure (i.e. to collapse in on itself) if laterally unsupported. In addition, large amounts of added downward force may be impractical.

Other attempts to overcome drag forces have involved pumping fluid through the casing string and back up to the surface through the annular space between the casing and wellbore wall as the casing is being run downhole. This method can be insufficient to reduce the drag forces and is not always practical during casing operations. In such cases, a casing buoyancy system may need to be deployed.

In the late 1980s, Union Oil Company of California ("UNOCAL") devised a method by which casing was "floated" into the wellbore using a casing buoyancy system, as described in U.S. Pat. No. 4,986,361. Casing Buoyancy Systems (CBSs) are typically installed in lower sections of the casing string, isolating the lower section to create an "air chamber" that will float as it is lowered downhole. The air chamber creates a buoyant effect that reduces the casing weight, resulting in less drag between the casing and formation. In addition, pressures from fluids injected above the CBS can then be used to further aid in lowering the string to depth. The CBS is often commonly positioned within the string such that the system will land at or near the start of the horizontal section of the wellbore, referred to as the 'heel'.

CBSs operate by trapping atmospheric pressure (air) in a lower section of the casing string and by allowing hydraulic fluid pressures above the system to 'push' the casing string farther downhole. Sealing-off a lower air-filled 'floating' portion of the casing string from an upper fluid-filled portion creates a higher downward force on the string due to the fluid mass in the upper portion, and less drag force in the lower portion due to the relative buoyancy effect. In this way, CBSs aid in overcoming the overwhelming drag forces that resist the casing string being run in hole.

Given that CBSs obstruct fluid flow through the casing string, however, systems need to be capable of holding pressures from both above and below the CBS. Once casing on bottom is achieved and a fluid flow path needs to be reinstated downhole, some CBSs require fluid pressures above the system to be increased until a seal or rupture assembly within the system bursts or ruptures, as described in U.S. Pat. No. 10,208,564. Other CBSs require system components to be drilled out (e.g., typically drillable with PDC bits). Debris created during the removal of CBSs is pumped downhole into a debris catching device. Unfortunately, however, rupturing or drilling out of known CBSs not only results in a significant amount of debris being circulated downhole, but also has the potential to damage equipment downhole (e.g., resulting in inadvertent failure of float equipment positioned downhole). Built-up debris in the well before cementing operations can increase the risk of failure for cementing operations, and the removal of excess cement that has cured in the wellbore can lead to increased costs.

Once the flow path through the casing string is restored, cementing operations for securing the casing string in place can then begin. Cementing operations typically involve the use of one or more cementing plugs that can be used to move cement flowing through the string all the way out of the casing string into the annulus between the string and the wellbore, and also to prevent the mixing of cement with other fluids (e.g., displacement fluids) during this process.

There remains a need for improved CBSs for use during casing operations, and preferably for CBSs that can also make use of standard equipment and processes used for cementing operations. Such improved CBSs may minimize the amount of debris created downhole during casing and cementing operations, thereby minimizing the amount of equipment needed and the operational risks of both processes. Such improved CBSs may also enable restoration of a full internal diameter of the casing string (i.e., providing an unrestricted wellbore), such that various post cementing downhole operations may be performed. Such improved CBSs may also provide means for casing collapse protection.

SUMMARY

According to embodiments, apparatus and methodologies of use in subterranean wellbore operations, the apparatus comprising a substantially cylindrical housing having an uphole end and a downhole end and forming a housing bore, at least one inner tubular, sealingly received within the housing bore, and at least one outer tubular, releasably connected with the at least one inner tubular and sealingly positioned between and interfacing with both the housing and the inner tubular for preventing movement between the housing, the outer tubular, and the inner tubular, wherein at least a portion of the at least one outer tubular comprises at least one connector for controllably releasing the at least one inner tubular, and at least another portion of the at least one outer tubular comprises a dissolvable portion for controllably degrading. In some embodiments, the apparatus housing may comprise one or more tubulars.

In some embodiments, the apparatus may be operably connected to a casing string being run into the wellbore during, without limitation, casing operations, cementing operations, or a combination thereof.

In some embodiments, the at least one inner tubular may comprise at least two inner tubulars, and in other embodiments the at least one outer tubular may comprise at least two outer tubulars.

In some embodiments, the at least one connector comprises at least one mechanical connector, wherein the at least one connector may comprise an annular ring.

In some embodiments, the dissolvable portion of the at least one outer tubular may further comprise at least one reactive material for enhancing the controlled degradation of the dissolvable portion.

In some embodiments, the housing forms an annular shoulder within the housing bore, and a downhole end of the outer tubular may abut the annular shoulder.

In some embodiments, the housing forms an annular groove within the housing bore, and at least a portion of the outer tubular may be received and retained within the annular groove.

In some embodiments, the apparatus may further comprise at least one disc for controllably restricting fluid flow through the housing bore.

In some embodiments, the apparatus may be further configured to receive and operably connect with at least one plug.

According to embodiments, apparatus and methodologies for use during subterranean wellbore operations are provided, the method comprising running an apparatus into the wellbore, the apparatus having a substantially cylindrical housing having an uphole end and a downhole end and forming a housing bore, at least one inner tubular, sealingly received within the housing bore, and at least one outer tubular, releasably connected with the at least one inner tubular and sealingly positioned between and interfacing with both the housing and the inner tubular for preventing movement between the housing, the outer tubular, and the inner tubular, wherein at least a portion of the at least one outer tubular comprises at least one connector for controllably releasing the at least one inner tubular, and at least another portion of the at least one outer tubular comprises a dissolvable portion for controllably degrading, triggering the at least one connector portion of the at least one outer tubular to release the at least one inner tubular downhole, and allowing the at least one dissolvable portion of the at least one outer tubular to disintegrate.

In some embodiments, the method may further comprise rupturing at least one disc restricting fluid flow through the housing bore before or after trigger the least one connector, wherein the at least one connector may be triggered after the disc for reopening the wellbore during casing operations.

In some embodiments, the at least one connector is triggered by running at least one plug into the wellbore.

In some embodiments, the wellbore operations may, without limitation, comprise casing operations, cementing operations, or a combination thereof.

In some embodiments, the method may further comprise running at least one plug into the wellbore before, after, or at the same time as the apparatus. In some embodiments, the apparatus may be slidably received within a central bore of a casing string being run into the wellbore.

FIGURES

FIG. 1 provides a schematic representation of an extended reach wellbore, wherein the horizontal (lateral) section of the wellbore is longer than the vertical and inclined (curved) sections, according to embodiments;

Figure 8:
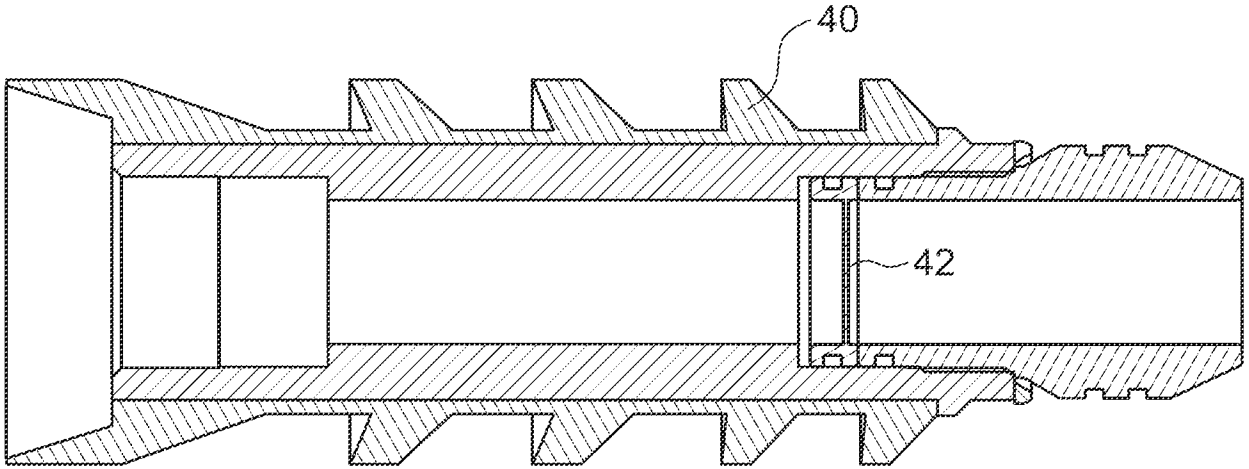
Figure 9A:
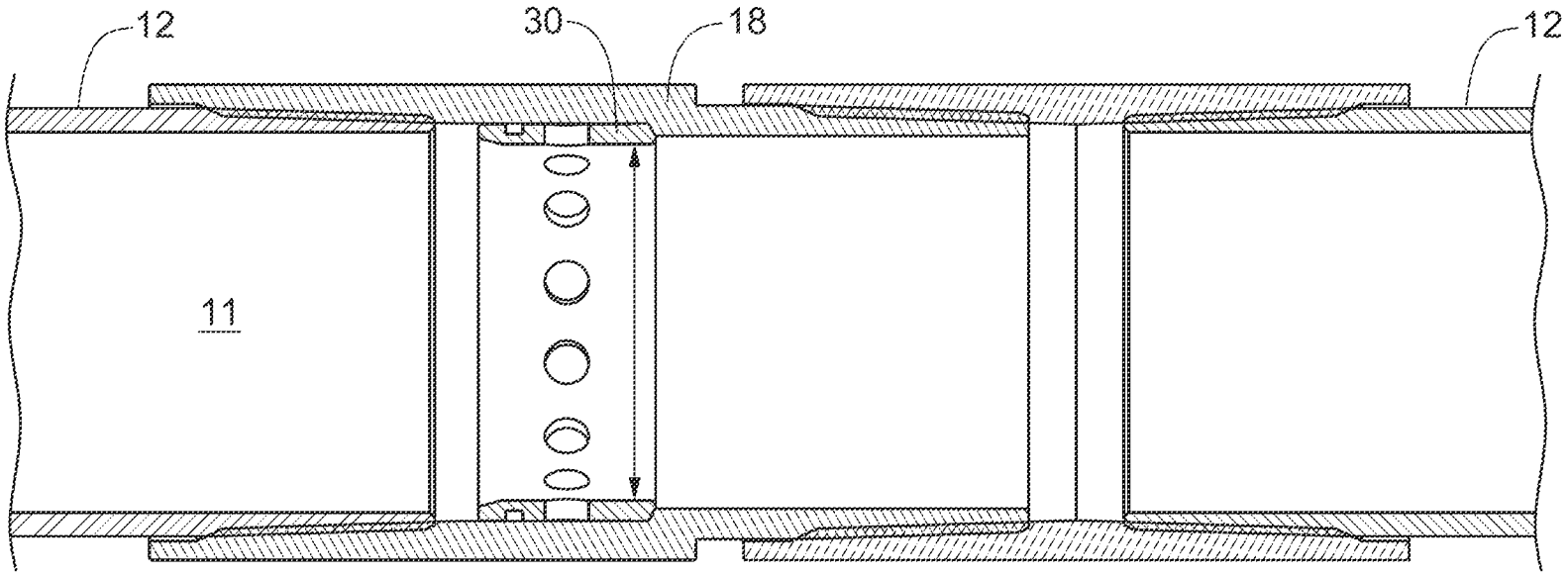
Figure 9B:
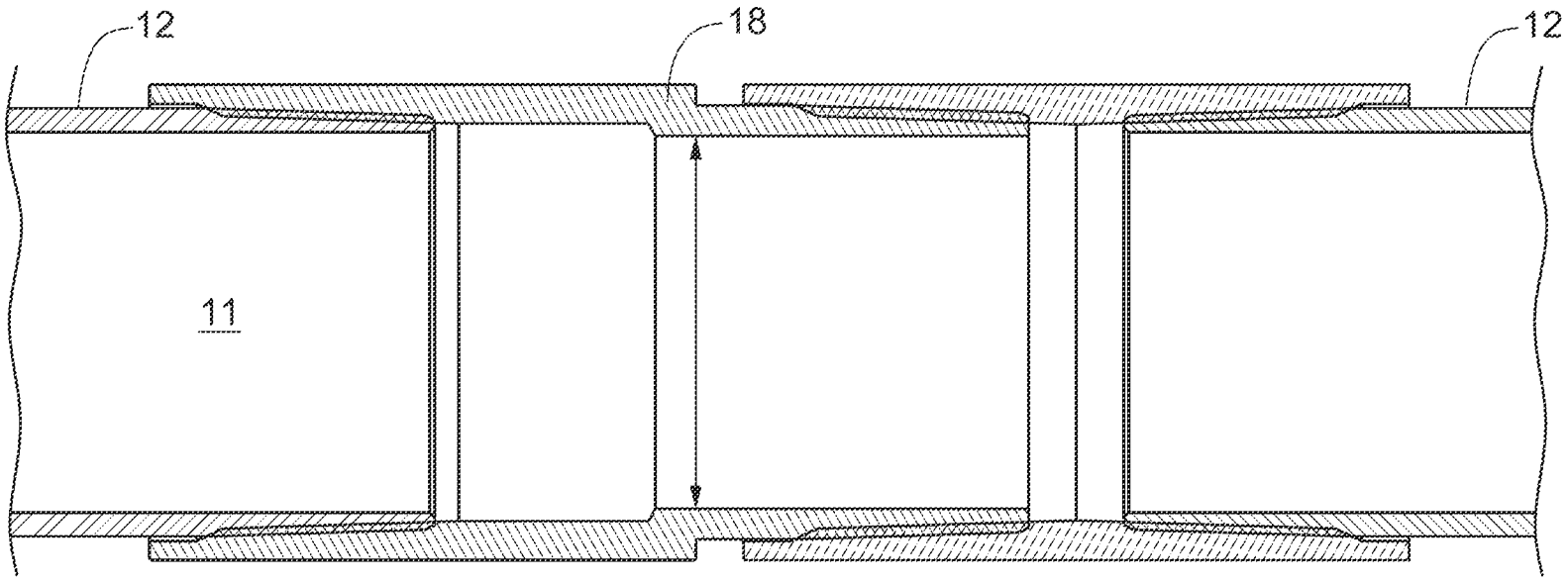
Figure 10:
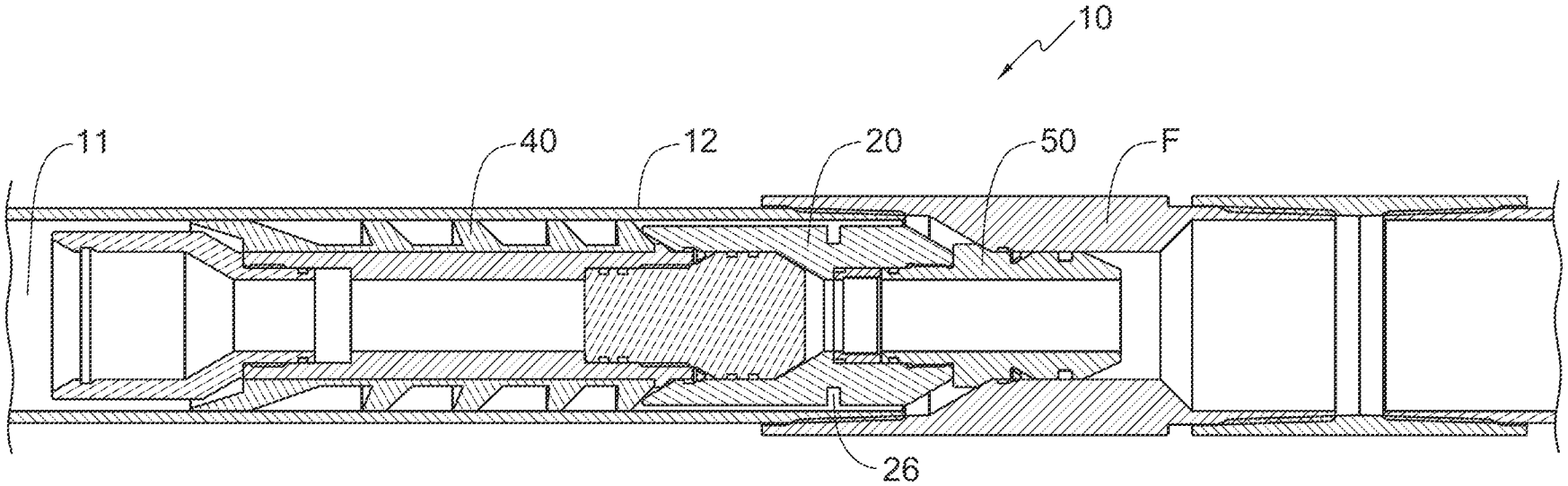
Figure 11:
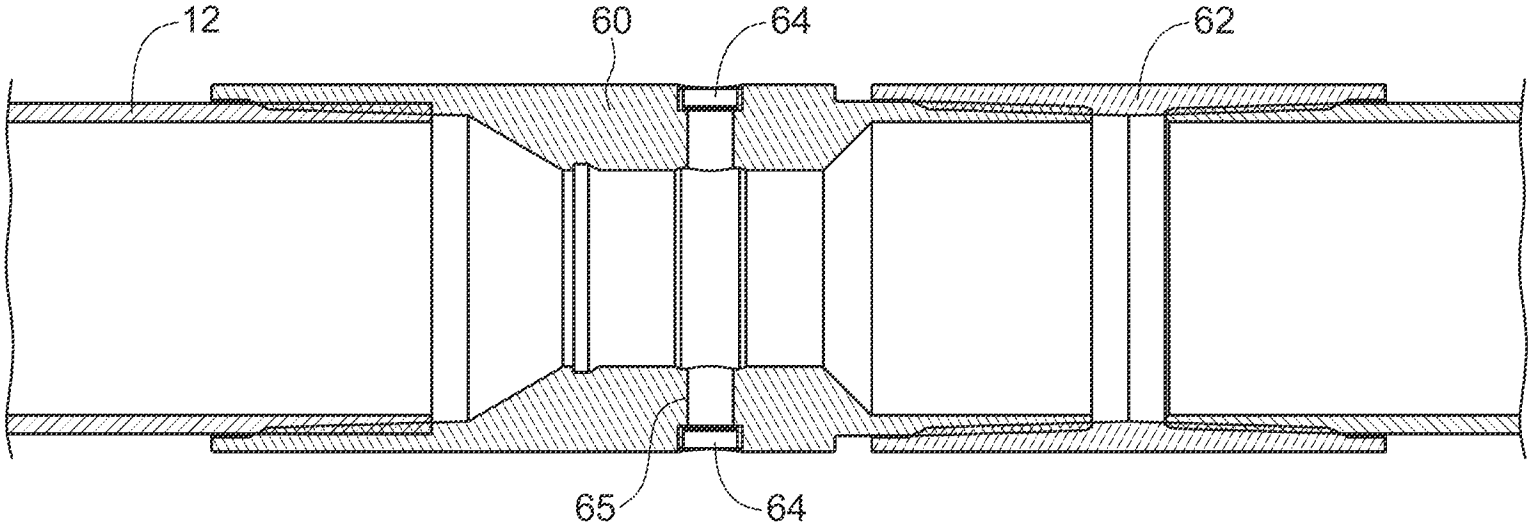
Figure 12:
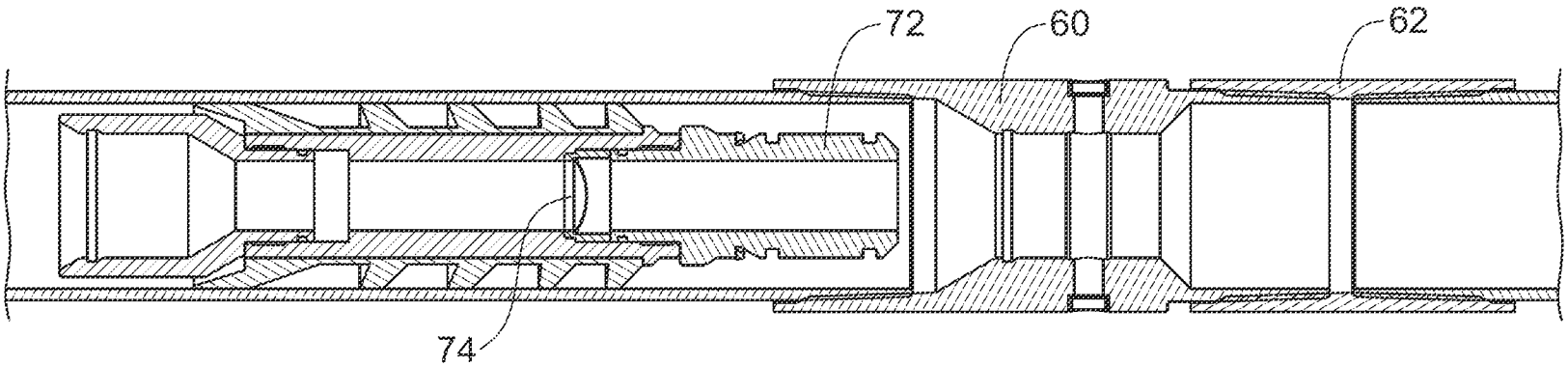
Figure 13:
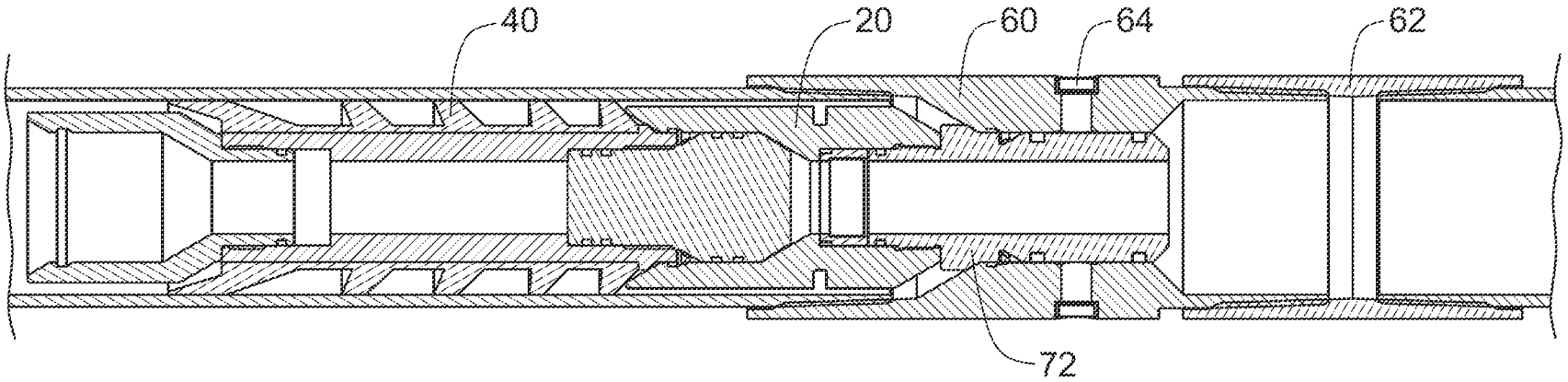
Figure 14:
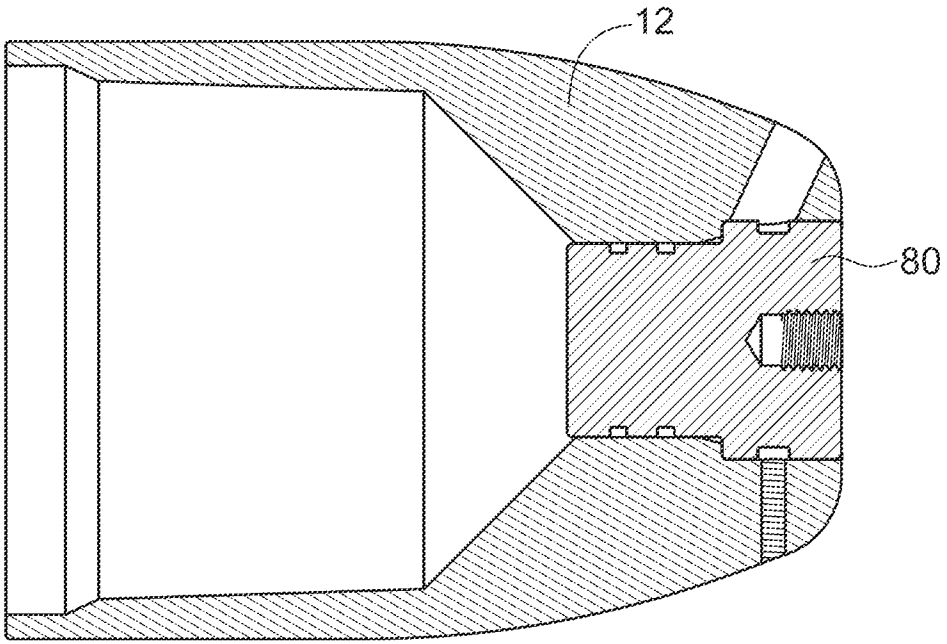

FIG. 8 is an isolated cross-sectional side view of at least one uphole cement plug that may be operably connected with the present apparatus, the uphole plug being shown as having a rupture disc, according to embodiments, FIGS. 9A and 9B show cross-sectional side views of the apparatus where the outer tubular is shown in isolation (FIG. 9A), and where the outer tubular has dissolved (FIG. 9B), according embodiments;

FIG. 10 is a cross-sectional side view of one embodiment of the present apparatus shown landed in a float collar, according to embodiments;

FIG. 11 is a cross-sectional side view of a conventional casing string protection apparatus for use in combination with the present apparatus, according to embodiments;

FIG. 12 is a cross-sectional side view of the casing string protection apparatus shown in FIG. 11 (apparatus 10 not shown), the protection apparatus shown receiving at least one cement plug, according to embodiments;

FIG. 13 is a cross-sectional side view of the casing string protection apparatus shown in FIGS. 11 and 12, the apparatus having landed the at least one cement plug, according to embodiments;

FIG. 14 is a cross-sectional side view of an alternative toe CT end of a casing string, said string comprising a bullet nose with a shear out buoyancy plug.

DETAILED DESCRIPTION OF THE EMBODIMENTS

According to embodiments, a modified casing buoyancy system is provided, the apparatus being advantageously operative as either one or both a casing buoyancy tool during casing operations and a cement plug during cementing operations, providing an unrestricted internal diameter wellbore following, for example, cementing, milling, cleanout, scale removal, frac operations, etc. The presently modified casing buoyancy system may be used alone or in combination with a casing collapse protection system.

Broadly, in first embodiments, the presently modified apparatus may be run in hole during casing operations, the apparatus being securely positioned within the casing string to sealingly engage the inner wall of the casing string and isolating an air-filled portion therebelow. As above, the sealed lower portion of the casing string becomes buoyant and assists with floating the string farther downhole. As will be described in more detail, the modified apparatus may be operably connected to at least one cement plug(s) for use during cementing operations. In this regard, the presently modified apparatus may be controllably converted for use as one or more cement plug(s) during cementing operations.

More specifically, according to some embodiments, the presently improved apparatus may initially serve as a CBS by trapping air in a sealed-off lower portion of the casing string when the casing is run in hole. When casing on bottom has been achieved, the presently improved apparatus may be controllably opened without dislodging the apparatus from its position therein, allowing trapped air within the string to be vented uphole at the surface and restoring the internal diameter of the casing string for standard cementing operations. Maintaining the CBS within the bore of the casing string necessarily eliminates issues arising from the entire CBS being ruptured the resulting debris being circulated downhole.

When cementing operations are in progress, the presently improved apparatus may then serve as a cement plug by receiving and latching at least one cement plug(s) pumped downhole, resealing the bore of the casing string. With the bore of the string plugged, fluid pressures above the apparatus can be increased to dislodge the apparatus from its position, allowing the entire apparatus to convert to a cement plug until it securely lands in and latches with a conventional landing collar and/or float equipment (e.g., shoe) positioned downhole. In such embodiments, the presently improved apparatus may serve as both a casing buoyancy tool during casing operations and a cement plug during cementing operations.

Broadly, in alternative embodiments, the presently modified apparatus may be run in hole during casing operations and securely positioned within the casing string to assist with floating the string farther downhole, serving as a casing buoyancy tool as outlined above. However, when casing on bottom has been achieved, and prior to cementing commencing, the presently improved apparatus may be pumped downhole to land at or near the toe T of the wellbore until it securely lands in and latches with a conventional landing collar and/or float equipment, without creating any debris or shearing remnants within the wellbore. In this manner, the present apparatus can be used to ensure a restored casing diameter prior to cementing operations, minimizing operational risks related thereto. Moreover, advantageously, should the apparatus become lodged within the wellbore, it could still readily receive at least one wiper plug, or the like, to assist its travel downhole, as necessary, or to be removed from the wellbore using wireline or coiled tubing, as known in the art. In such alternative embodiments, it is contemplated that the presently improved apparatus may serve as a casing buoyancy tool during casing operations that can then be used to remove obstructions within the wellbore in preparation for cementing operations. Once positioned at or near the toe T of the wellbore, the apparatus can readily be opened to establish circulation if/when cementing operations are set to begin. As will be described, it is also contemplated that the presently improved apparatus may serve to provide a casing buoyancy tool that can be used for multiple casing string weights.

The presently improved apparatus and methods of use will now be described in more detail having regard to FIGS. 1-14.

In the present description, the terms "above/below" and "upper/lower" are used for ease of understanding and are generally intended to mean the relative uphole and downhole from surface.

Figure 1:
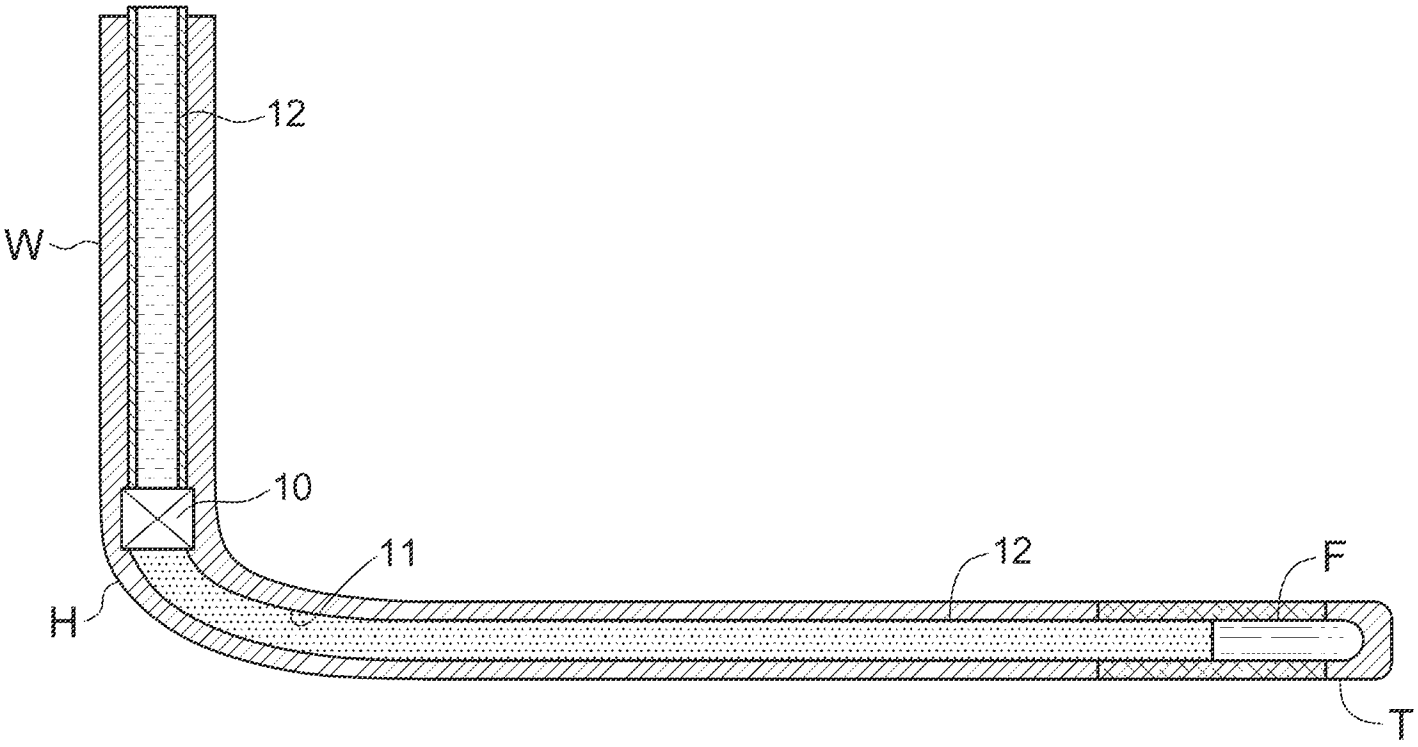

Having regard to FIG. 1, a first embodiment of the presently improved apparatus 10 is provided, the apparatus 10 being configured to be run in hole with standard casing string 12 (or liner) during casing operations of a subterranean wellbore W. The apparatus 10 may be positioned within central bore 11 the string 12, such that it lands at or near a directional or 'heel' H portion of the wellbore W.

As would be appreciated, the casing string 12 may comprise conventional landing collars/float equipment (e.g., float shoe, F) and/or other bottomhole componentry at the 'toe' T section of the wellbore W. As would also be appreciated, the present apparatus 10 may be configured to be compatibly operative within standard threaded connections used for downhole equipment such as conventional 4½" or 5½" LTC or BTC API casing connection subs. The present apparatus 10 may also be configured for operable connection with at least one cement plug.

Figure 2A:
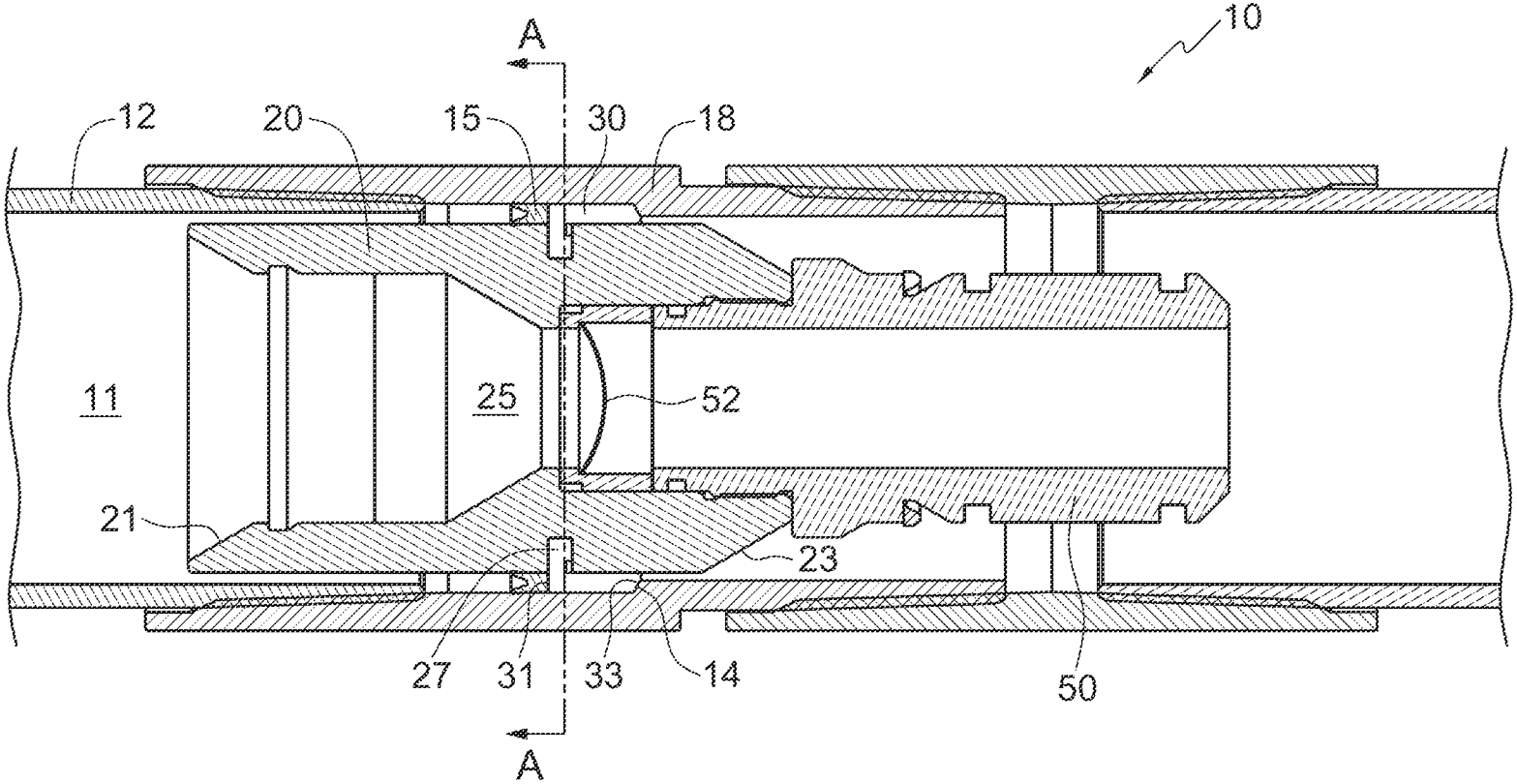
FIG. 2A is a cross-sectional side view of a first one-piece housing embodiment of the present apparatus, according to embodiments.
Figure 2B:
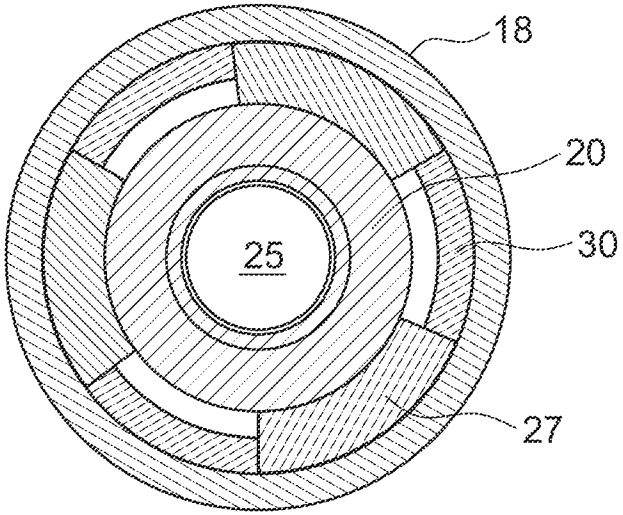
FIG. 2B is a cross-sectional top-down view of the embodiment of the present apparatus shown in FIG. 2A (taken along lines A-A)

According to embodiments, having regard to FIG. 2A, the present apparatus 10 may comprise a housing 18 for sealingly receiving and housing at least one internal tubular component of apparatus 10 (described herein), housing 18 being sized and shaped for positioning within standard casing string 12. Housing 18 may comprise a single tubular component 18 (e.g., see FIG. 2D) or more than one tubular components 18*a*, 18*b* operably connected (e.g., see FIG. 36).

In some embodiments, apparatus 10 may be threadably engaged within standard casing string 12 via threaded pin and box connections above and below housing 18. Threadably engaging a single tubular housing 18 within casing 12 advantageously reduces the need for additional connections, e.g., cross-over subs, and eliminates any corresponding componentry used support such additional connections, e.g., seals. Threadably engaging a single tubular housing 18 within casing string 12 also advantageously ensures an overall outer diameter of apparatus 10 that is equal to or less than the outer diameter of native couplings of standard casing string 12, maintaining the annular clearance of the string 12 within the wellbore without impacting (sacrificing) the torsional strength of the string 12.

More specifically, without limitation, a one-piece single tubular housing 18 might offer significant structural advantages that lend functional benefits. A single tubular housing 18 may consist of a smaller outer diameter (i.e., the tool can be 'slimmer'), with the outer diameter advantageously being no larger than the outer diameter of couplings used in the threaded connections of the casing string. Minimizing the outer diameter of the present apparatus 10 reduces risks that can arise during cementing operations where the annular space between the casing string 12 and the wellbore wall becomes more restrictive. Minimizing the outer diameter of the present apparatus 10 also reduces risks of the apparatus 10 interfering with fishing operations, where the slimmer tool can enable easier retrieval of the lower power of the casing string 12. The foregoing benefits are provided while still maintaining maximum bearing areas to support the necessary loads (e.g., interface between outer tubular 30 and shoulder 14 as described below), and while still minimizing connections/seal requirements.

In some embodiments, more than one tubular housing 18 may be advantageous for use with premium casing connections.

More specifically, without limitation, a two-piece or multi-piece tubular housing 18 may also offer structural advantages that lend functional benefits. A multi-tubular housing 18 may be compatibly operative within, for example, semi-premium or premium connection (e.g., as provided by Hydril, Tenaris, VAM, or the like). A multi-tubular housing 18 may further provide structural advantages including providing larger contact areas with the housing 18 in the event of weaker dissolvable materials (e.g., where dissolvable consists of magnesium alloy, or the like, as will be described). Without limitation, it is contemplated that embodiments of a single-housing apparatus 10 may still be compatible within semi-premium or premium connections.

According to embodiments, having further regard to FIG. 2A, housing 18 may be configured such that apparatus 10 is securely positioned with the bore 11 of the casing string 12, said apparatus comprising at least one first inner tubular 20 and one second outer tubular or sleeve 30 positioned about the outer circumference of inner tubular 20.

Figure 4A:
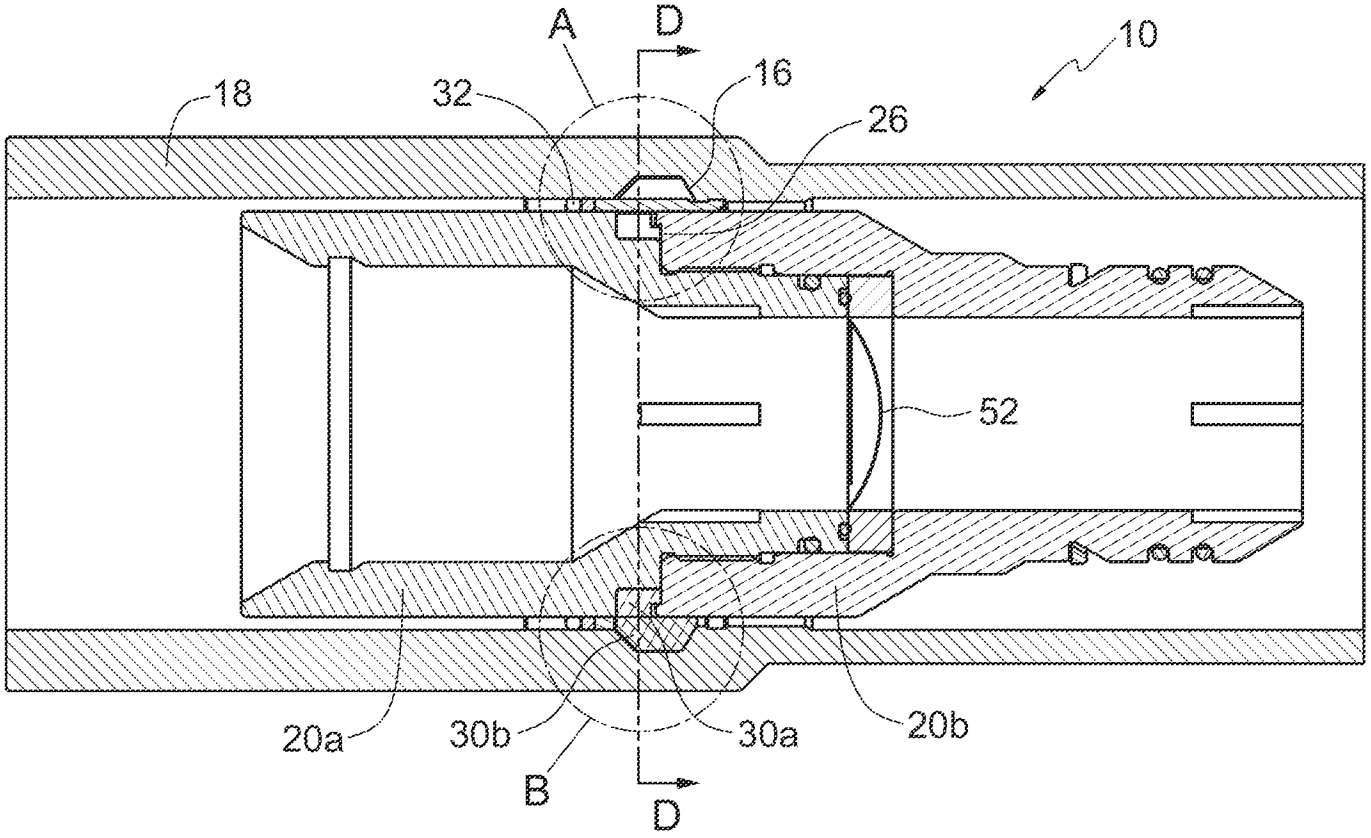
FIG. 4A is a cross-sectional side view of an alternative one-piece housing embodiment of the present apparatus, the embodiment having a two-piece inner and outer tubulars, according to embodiments.

In some embodiments, housing 18 may be configured to comprise means for securing the apparatus 10 to prevent the apparatus 10 (i.e., including housing 18 and inner, outer tubulars, 20, 30) from inadvertently traveling within the string 12. By way of example, as shown in FIG. 2A, the inner surface of the housing 18 may form an annular stop or shoulder 14 for abutting the body of the apparatus 10, preventing the apparatus 10 from inadvertently traveling downhole. Annular shoulder 14 may be configured so as to interface with and abut apparatus 10 (e.g., outer sleeve 30 of apparatus 10), or in any other manner as may be appropriate in the art. By way of alternative example, as shown in FIG. 4A, the inner surface of the housing 18 may form an annular groove 16 for receiving and retaining apparatus 10, preventing the apparatus 10 from inadvertently traveling downhole. Annular groove 16 may be configured so as to receive at least a portion of apparatus 10 (e.g., a portion of outer sleeve 30 of apparatus 10, as will be described), or in any other manner as may be appropriate in the art.

According to embodiments, apparatus 10 may be secured within housing 18 temporarily, i.e., the apparatus 10 may be controllably released downhole if desired. According to embodiments, means for triggering release of apparatus 10 may comprise a combination of at least one pressure-activated mechanical connector or release/shear component and at least one time or composition-activated dissolvable material component.

Returning to FIG. 2A, in some embodiments, inner tubular 20 may be substantially cylindrical in shape, having an uphole end 21 and downhole end 23 and forming inner bore 25 therethrough. Inner tubular 20 may comprise a single tubular element 20 (e.g., as shown in FIG. 2A), or preferably more than one tubular element 20*a*, 20*b* operably connected (e.g., as shown in FIG. 2D), as will be described in more detail. Inner tubular 20 may be releasably and sealably connected with outer tubular 30. In some embodiments, at least one annular seal 15 may be positioned between the inner tubular 20 and housing 18, the annular seal 15 advantageously serving to protect dissolvable materials in or around outer tubular 30 from the harsh wellbore environment.

Figure 3A:
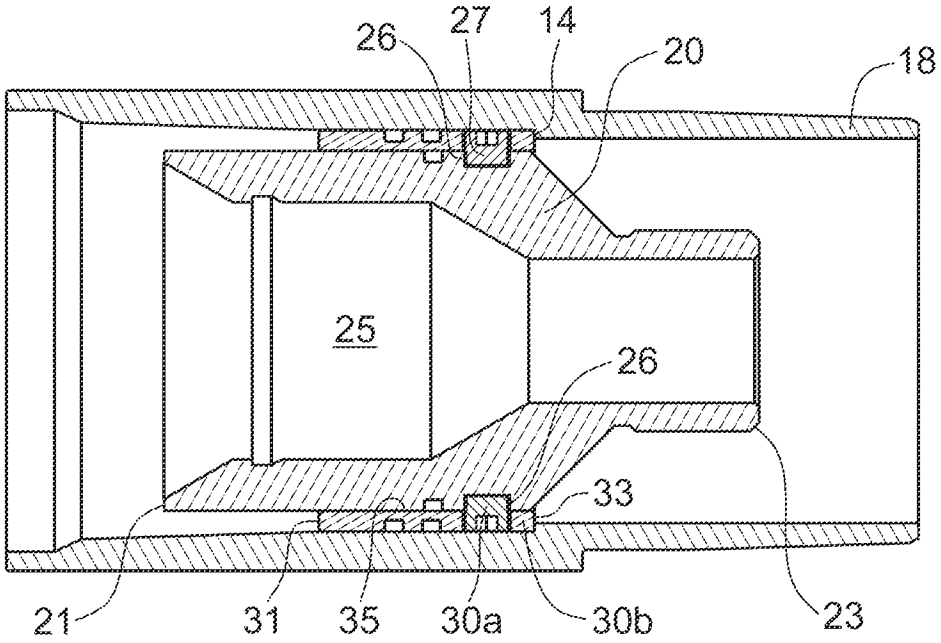
FIG. 3A is a cross-sectional side view of an alternative one-piece housing embodiment of the present apparatus, the embodiment having separate mechanical connection means, according to embodiments.
Figure 3B:
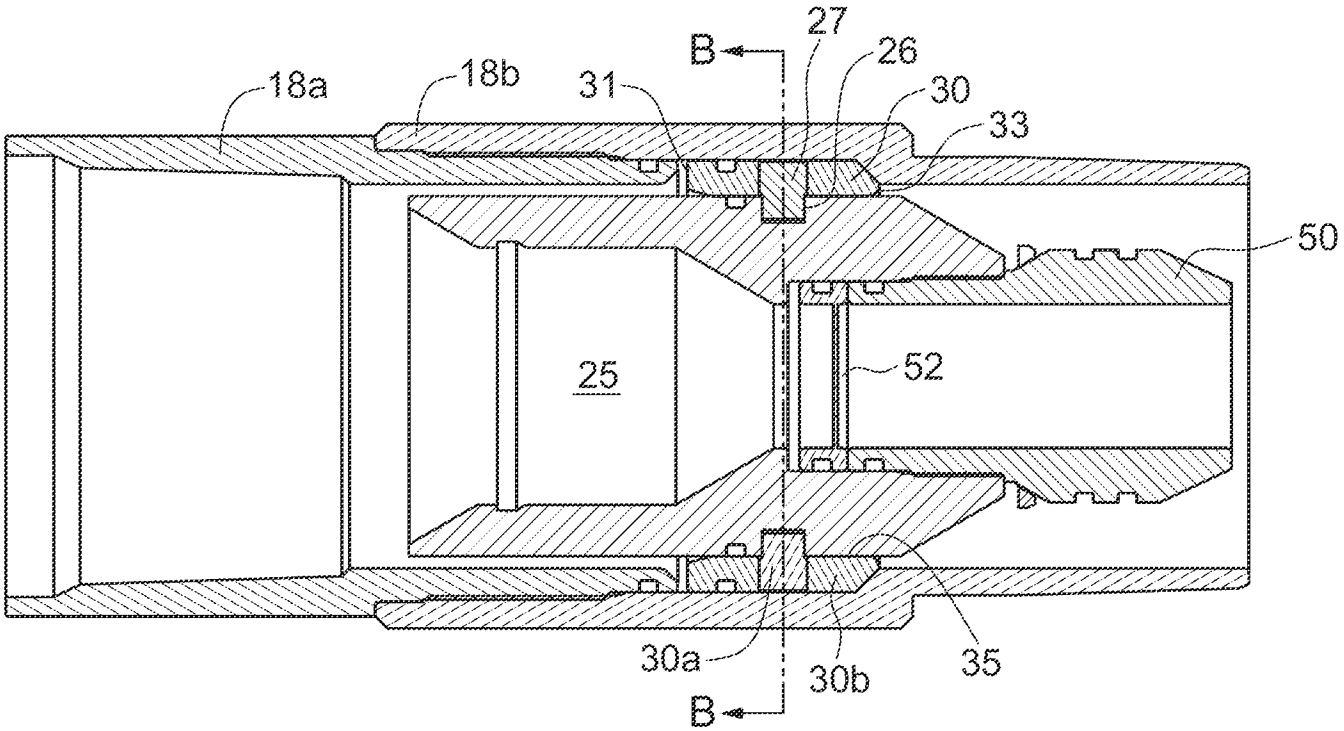
FIG. 3B is a cross-sectional side view of a second two-piece housing embodiment of the apparatus shown in FIG. 3A, the embodiment having separate mechanical connection means, according to embodiments.
Figure 3C:
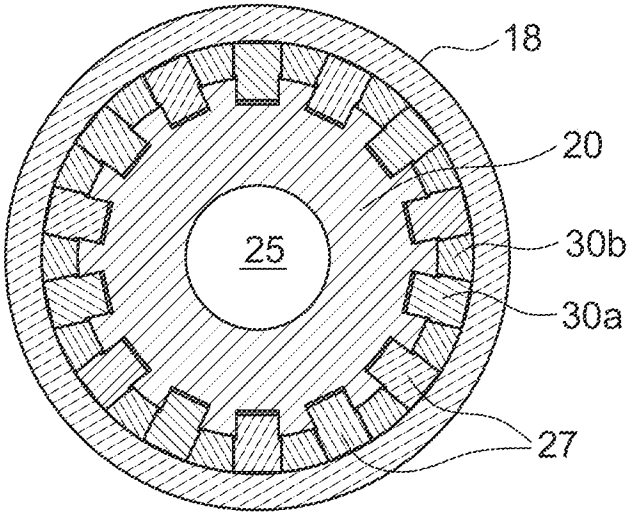
FIG. 3C is a cross-sectional top-down view of the alternative embodiments shown in FIG. 3A or 3B (taken along lines B-B), according to embodiments.

In some embodiments, outer tubular 30 may be substantially cylindrical in shape, having an uphole 31 end and downhole end 33 and forming inner bore 35 therethrough (e.g., as noted in FIG. 3A). Outer tubular 30 may comprise a single tubular element 30 (e.g., as shown in FIG. 2A), or preferably outer tubular 30 may comprise more than one tubular component 30*a*, 30*b* operably connected (e.g., as shown in FIG. 3A, 4A). Central bore 35 of outer tubular 30 may be sized and shaped such that outer tubular 30 may be releasably and slidably positioned about the outer circumference of inner tubular 20.

Outer tubular 30 may be configured so as to interface with or abut with inner tubular 20 and/or housing 18, preventing movement of apparatus 10 within the casing string 12. As above, in some embodiments, downhole end 33 of outer tubular 30 may be configured so as to interface with and abut with annular shoulder 14 of housing 18 (e.g., as shown in FIG. 3A), while in other embodiments, outer tubular 30 may be configured so as to be received within an annular groove 16 of housing 18 (e.g., as shown in FIG. 4A).

According to embodiments, without limitation, outer tubular 30 may comprise an inner diameter ranging from approximately 3.65-3.85" (i.e., a 4.00" nominal ID API casing with a 3.88" drift diameter), enabling sufficient clearance between the tubular 30 and the inner diameter of the casing string 12. It should be appreciated that the minimum internal diameter of outer tubular 30 may be determined by the maximum required pass-through diameter, while still providing increased fluid flow area. Outer tubular 30 may be configured to maintain similar clearance in casings of different weight and size (e.g., 4.5"×11.6/13.5/15.1 lb/ft casing) and may also provide a larger flow area for air to vent up the well after the apparatus 10 has been sheared. Moreover, given that the nominal internal diameter of the casing string is 4.00", the reduced outer diameter of tubular 30 ensures that the present apparatus 10 may easily travel through the wellbore (e.g., through over-torqued casing connections, restrictions in the internal diameter of the casing string 12 created by the formation, or the like).

Outer tubular 30 may be manufactured in whole or in part from an impermanent material, such as a dissolvable material. For example, outer tubular 30 may function as a controllable internal diameter transformer, effectively operating to span the original outer diameter of the inner tubular 20 (e.g., 3.65"-3.75", as above), and then, when desired, dissolving away to restore the inner diameter of housing 18 (e.g., restoring an inner diameter of approximately 4.00"; see FIGS. 9A-9B, wherein arrows denote approx. nominal ID).

In some embodiments, at least a portion of outer tubular 30 may be manufactured from an impermanent material so as to controllably dissolve over time. Advantageously, outer tubular 30 can serve first as a temporary mechanical insert for securing the apparatus 10 in position within the casing string 12 (e.g., see FIG. 9A where tubular 30 is shown) until the mechanical connector or release means (shear pins) are triggered to release the inner tubular 20 downhole, and second as a controlled dissolvable to restore reopening of the full casing bore (e.g., see FIG. 9B). For example, in operation, a first portion of outer tubular 30 may comprise a mechanical connector portion (e.g., 30*a*, FIG. 3A) to controllably release the inner tubular 20 following casing operations, while a second portion of outer tubular 30 may comprise a dissolvable portion (e.g., 30*b*, FIG. 3A) for timed or delayed opening of the full casing bore for post cementing operations.

Without limitation, whether formed from one or more components, outer tubular 30 may be manufactured from one or more appropriate dissolvable materials known in the art. In some embodiments, the one or more dissolvable materials may comprise magnesium alloy and water or salt water, dissolvable alloys (e.g., TervAlloy™, JAS), magnesium and zirconium metals (e.g. Magnesium Elektron Ltd.), dissolvable metals and degradable elastomers (e.g. Parker Hannifin B.V.), corroding aluminum alloys (e.g. aluminum in HCl), or any other known materials operative to provide reliable, uniform degradation or dissolution rates within the wellbore environment (i.e., when exposed to various fluids, temperatures, and/or pressures). In some embodiments, at least one means for providing a sealed engagement between inner and outer tubular 20, 30 can serve to protect any dissolvable material from inadvertent or unintentional degradation due to the harsh wellbore environment (e.g., air below the seal and salt water above the seal).

Advantageously, in other embodiments, at least one means for providing a sealed engagement between inner and outer tubular 20, 30 can serve to assist or enhance the degradation of any dissolvable material. For example, where at least a portion of outer tubular 30 is manufactured from a dissolvable material, outer tubular 30 may be configured to receive and retain a reactive material for providing a more controlled and thorough dissolution of the dissolvable material. Reactive material may be any suitable matter known in the art and may be specifically tailored to degrade the dissolvable materials. For example, where the dissolvable material may comprise a dissolvable material, such as magnesium alloy, outer tubular 30 may be configured to receive and retain a reactive and/or catalytic material specifically tailored to interact therewith, such as chloride ions, where the ions may serve as a catalyst to controllably enhance the rate of reaction between the magnesium alloy and water. Advantageously, dissolution rates and times of dissolvable materials may be controlled by operators via, without limitation, the use of reactive materials and/or catalytic compounds, regardless of and independently from the wellbore fluid chemistries. In other words, where a full and fast dissolution of dissolvable materials is desired, the present apparatus 10 may be configured to receive and retain more reactive materials with one or more catalytic compounds also being used. Where a slower dissolution of dissolvable materials is desired, the present apparatus 10 may be configured to receive and retain less reactive materials without any catalytic compounds being used. In either case, the operator may control the dissolution rates of the dissolvable materials by loading more or less reactive materials, with or without catalytic compounds, despite what the downhole fluid chemistries might be at the particular location of the apparatus within the wellbore or as a result of the particular operations being performed.

As above, inner and outer tubulars 20, 30 may be releasably connected via one or more controllable connection means, such connection means comprising a combination of at least one mechanical connector portion and a dissolvable portion. Each of the mechanical connector and dissolvable portions may, in combination, serve to both retain the position of the apparatus 10 within the bore 11 of the casing string 12 (until such time as release of the apparatus downhole is desired) and to enable the full internal diameter of the bore 11 to be regained following said release of the apparatus 10. Although a mechanical connector/release portion is described herein, it should be appreciated that any other suitable means for controllably triggering the disconnection between tubulars 20, 30 is contemplated (e.g., hydraulic connectors, J-gap connectors, etc.).

More specifically, the at least one mechanical release portion may comprise any form of mechanical connection or connector(s) between tubulars 20, 30 that can be controllably activated to trigger release the connection therebetween. For example, having regard to FIGS. 2A and 2C, mechanical release portion may comprise at least one shear segment or shear pins 27, wherein the at least one shear segment 27 can be controllably sheared to trigger the separation of the tubulars 20, 30.

Advantageously, as will be described, the at least one mechanical connector portion may be set to trigger disconnection of tubulars 20, 30 either before or after at least one rupture disc or other mechanism operating to open bores 25, 35 and restore the wellbore. That is, depending upon operating parameters, the apparatus 10 may be configured to rupture at least one burst disc (e.g., 52 in FIG. 2A, 2C, 4A) prior to mechanically releasing (e.g., shearing) the connection between tubulars 20, 30, or the apparatus 10 may be configured to mechanically release the connection between tubulars 20, 30 first, pumping at least the inner tubular 20 downhole, prior to rupturing at least one burst disc to restore the wellbore.

In some embodiments, mechanical connector portion (e.g., shear segment 27) may be integrally formed within outer tubular 30 (FIGS. 2A-2D, 3 and 5). In such embodiments, the connection portion may be manufactured to be integrally formed with outer tubular 30 where at least a portion of the tubular 30 may also be formed using a dissolvable material. Outer surface of inner tubular 20 may form at least one receiver groove or slot 26 for receiving at least one mechanical connector portion (e.g., shear segment 27) of the outer tubular 30. When connector portion is in secured position within slot 26, movement of tubulars 20, 30 within housing 18 may be prevented by shoulder 14 (i.e., in the downward direction). When release portion is sheared from position to release tubular 20 downhole, the outer sheared portion of tubular 30 remains in position (abutting shoulder 14) until it dissolves.

Figure 2C:
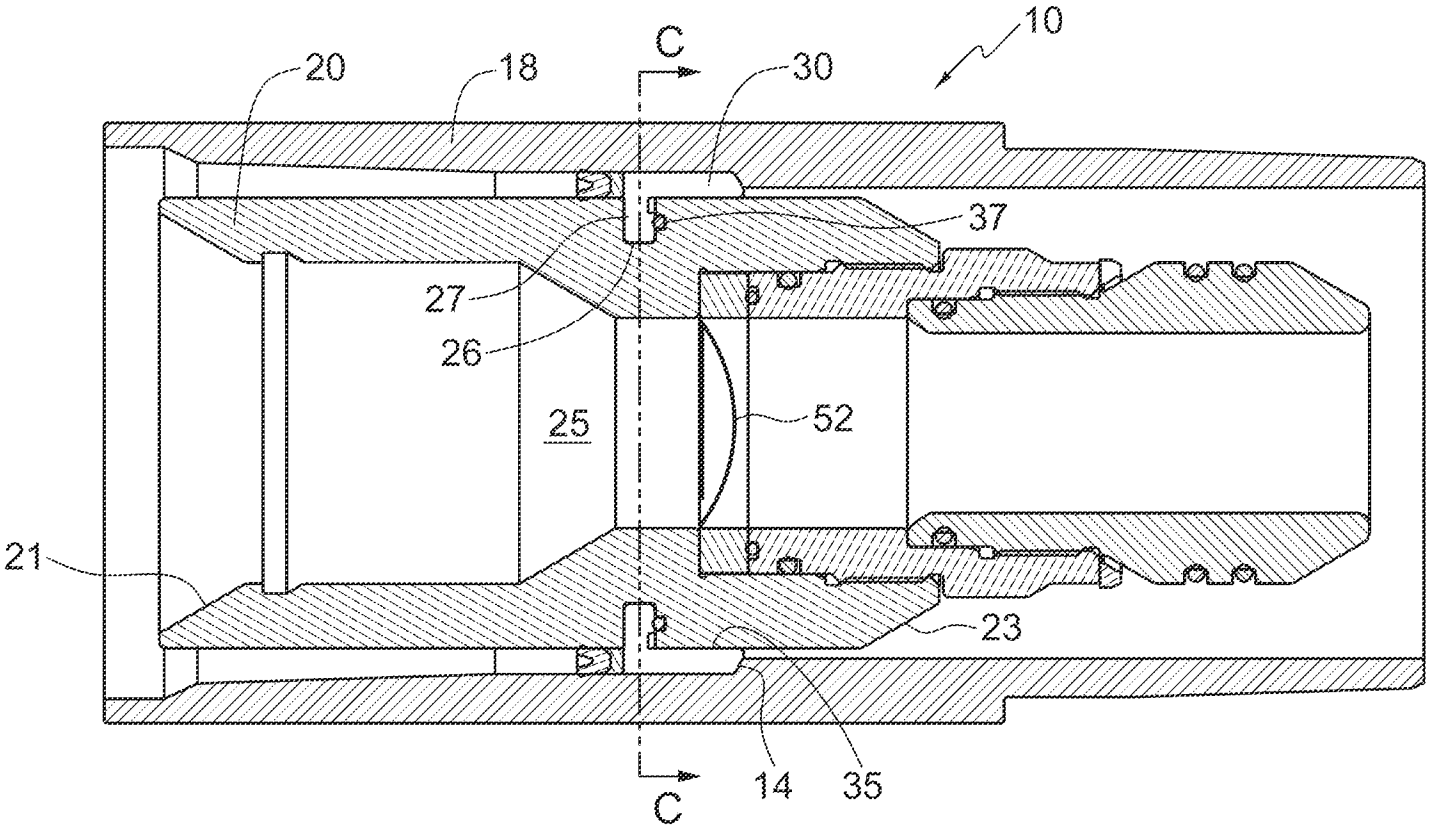
FIG. 2C is a cross-section side view of an alternative embodiment of the present apparatus shown in FIG. 2A, according to embodiments.
Figure 2D:
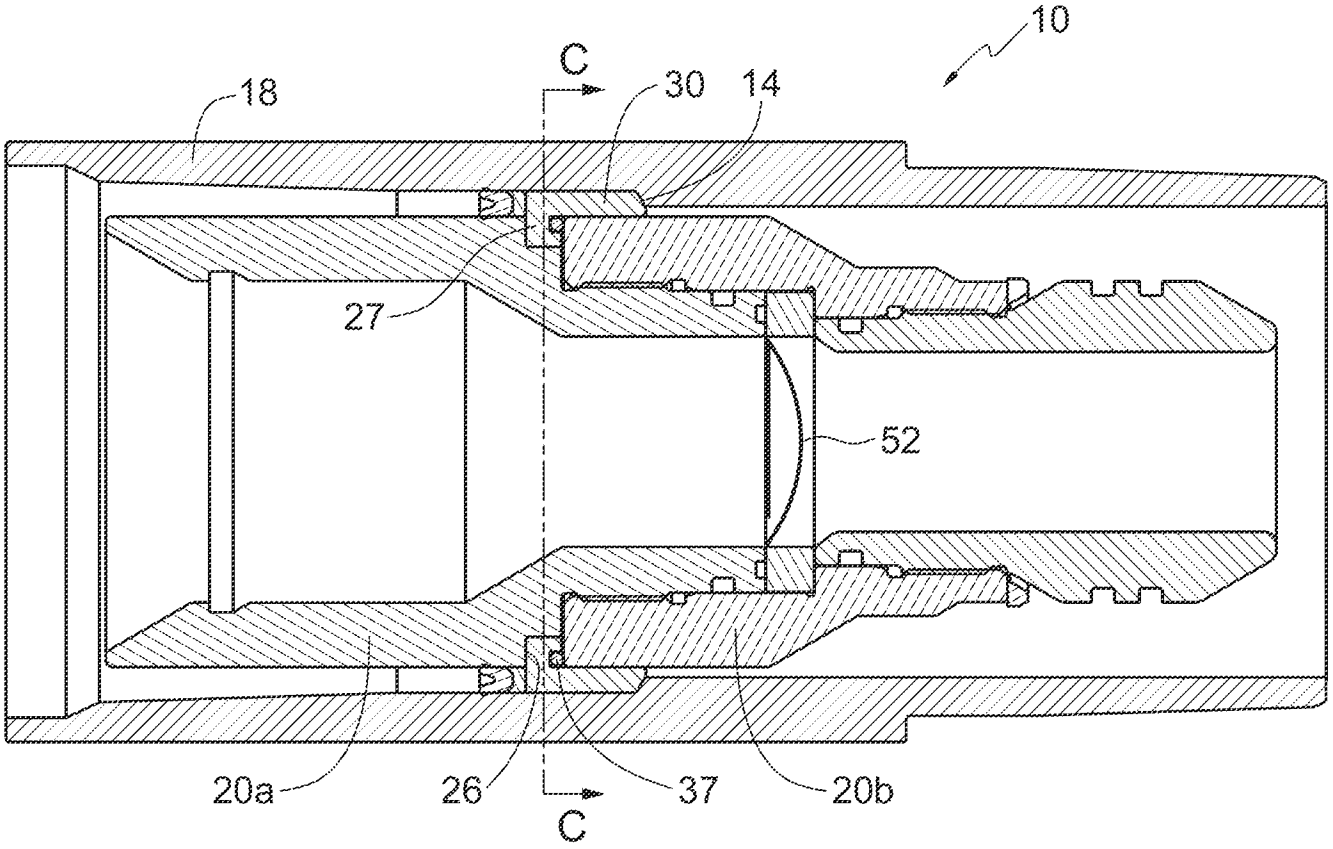
FIG. 2D is a cross-sectional side view of yet another alternative embodiment of the present apparatus shown in FIG. 2A, according to embodiments.
Figure 2E:
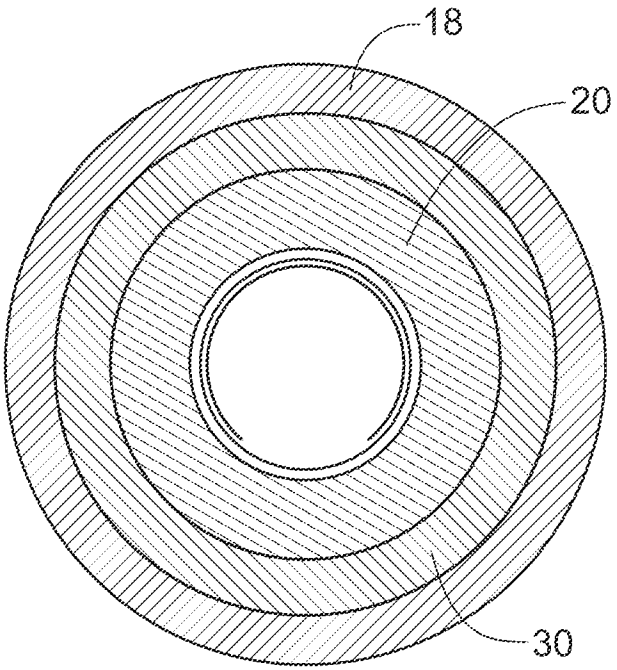
FIG. 2E is a top-down view of the embodiment of the apparatus shown in FIG. 2D (taken along lines C-C), according to embodiments.
Figure 5:
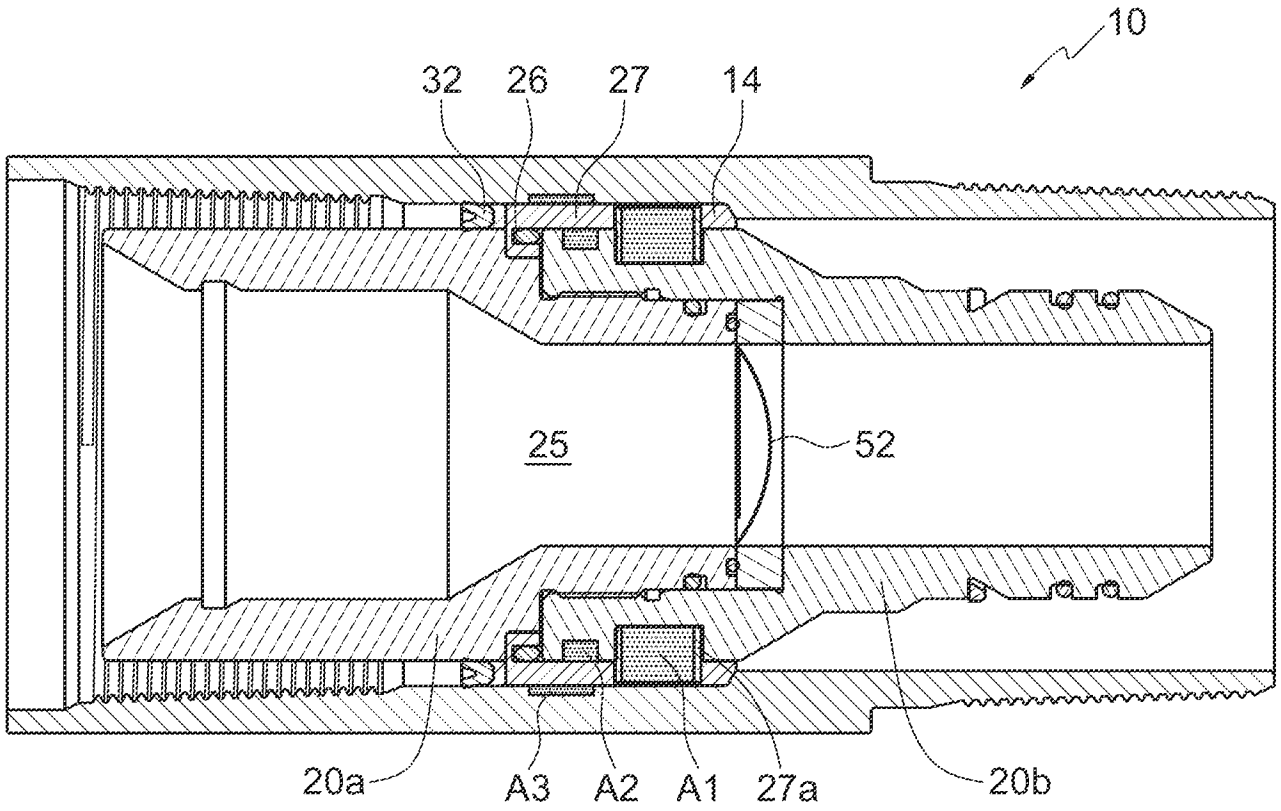
FIG. 5 is a cross-sectional side view of an alternative embodiment of the present apparatus, the apparatus containing reactive materials, according to embodiments.

Having specific regard to FIGS. 2C and 5, in some embodiments, the receiver groove or slot 26 of inner housing 20 may be formed at a junction or connection between a two-piece inner tubular 20*a*, 20*b*. At least one annular shear seal 37 may serve to retain a mechanical connection between in inner shear portion of segment 27 and the inner tubular 20 during shearing and afterward (i.e., to secure sheared portion of segment 27 within inner tubular 20 when said tubular 20 is released downhole).

Moreover, as above and having regard to FIG. 5, in some embodiments, outer tubular 30, and/or at least the connector portion, the dissolvable portions, or both, may further be manufactured to receive and retain a reactive material (e.g., A1, A2, A3) for enhancing the controlled degradation or break down/dissolution of the outer dissolvable portion of tubular 30. Reactive materials may be positioned within and/or near the sheared connector portion to enhance disintegration of the remaining portion thereof.

For example, in some embodiments, outer tubular 30 may be configured to provide one or more auxiliary connector(s) 27*a* to receive and retain a reactive material (e.g., A1). Such auxiliary connectors 27*a* may serve to initially enhance shear pressures of connector(s) securing tubulars 20, 30 together (e.g., summative pressures of connectors 27 and 27*a*) until burst disc 52 is ruptured, and then serving to dissolve away to reduce shear pressures of connector(s) to disconnect tubulars 20, 30 (e.g., connectors 27 alone). That is, in use, when apparatus 10 is run downhole with burst disc 52 in place, auxiliary connector(s) 27*a* may serve to increase shear strength required to shear connectors 27 (i.e., to resist higher pressure differentials across disc 52, with hydrostatic pressure above disc 52 and atmospheric pressure below disc 52). When burst disc 52 is ruptured and fluid(s) are permitted to enter and pass through bore 25, the fluid(s) contact and react with reactive materials (e.g., A1) to dissolve connectors 27*a*, leaving connectors 27 in place. When one or more cement plug(s) 40 are then pumped downhole to engage with the uphole end of inner tubular 30, fluid pressures required at surface to shear connectors 27 is reduced (i.e., shear rating above plug 40 drops), resulting in easier shearing of connectors 27 and disconnection of tubulars 20, 30 to pump inner tubulars 20*a*, 20*b* downhole (with plug 40).

Reactive and/or catalytic materials may be used to more accurately control the rate of dissolution of all or part the outer tubular 30, as desired, or to controllably achieve altered chemical properties at selective locations within the wellbore. In some embodiments, outer tubular 30 may be configured to receive, retain, and release a specified quantity of reactive materials serving to mix well with wellbore fluids to enhance reactions when shearing of tubulars 20, 30 occurs. For example, where at least a portion of outer tubular 30 comprises a dissolvable material, such as magnesium alloy, a predetermined quantity and concentration of reactive materials, such as chloride ions, may be positioned at one or more locations near the dissolvable material to control the dissolution/disintegration rates. Where a slower dissolution rate is desired, little to no reactive materials may be used. Where faster dissolution/disintegration rates of sheared portions of outer tubular 30 are desired, a predetermined quantity of reactive materials may be positioned within the outer sheared portion (A1), the inner tubulars 20*a*, 20*b* (A2), and/or within housing 18 (A3). In this manner, for example, the disintegration rate of the outer sheared portion 27 may be controllably determined to occur over a few hours, a day, or several days, as desired.

It should be understood that different reactive materials might be selected based upon the desired dissolution rates, i.e., faster dissolution of dissolvable materials may need fast dissolution materials (e.g., SoluMag®FW from Luxfer MEL Technologies, UK) vs slower dissolution may need slow dissolution materials (e.g., SoluMag®1100 from Luxfer MEL Technologies, UK). Moreover, it should be understood that different reactive materials may be selected so as to enable lower disconnection or shear pressures to be used (i.e., where the sheared connection portion dissolves more quickly, the disconnection pressure required to shear the segment may be lowered). Such an advantage may prove useful in deeper wellbores, or in circumstances where set shear pressures are difficult to achieve.

In other embodiments, alternatively, the mechanical connector portion may be distinctly formed in outer tubular 30 (FIGS. 3A-3C), where at least another distinct portion of outer tubular 30 is made using a dissolvable material. In such embodiments, the connector portion of outer tubular 30 may be formed separately from the dissolvable material portion. Outer surface of inner tubular 20 may be configured to form at least one receiver groove or slot 26 for receiving at least one connector portion (e.g., shear segment or pin 27), which still serves to the dissolvable portion of outer tubular 30 in position, i.e., where outer tubular 30 forms two portions comprising a connector portion 30*a* serving as pin 27, and a dissolvable portion denoted 30*b* which is retained in place upon shearing by shoulder 14. When pin 27 is sheared from position to release tubular 20 downhole, the un-sheared portion of tubular 30*b* remains in position until it dissolves.

Mechanical connector (e.g., shear pins 27) may be manufactured from any appropriate materials known in the art including, for example, brass. Advantageously, providing separate mechanical connection means such as shear pins can enable tighter, more controlled shear tolerances, ensuring that the present apparatus 10 may be easier to control (i.e., less variability in shearing pressures required).

In some embodiments, mechanical connector may be integrally formed within outer tubular 30, where the connector (shear) portion 30*a* may be manufactured from the same dissolvable material as the dissolvable portion 30*b* (FIGS. 4A-4J). As will be described, inner surface of housing 18 may form at least one annular groove or slot 16 for receiving at least one dissolvable retainer portion 30*b*. Retainer portion 30*b* may secure apparatus 10 in position within housing 18 and may enable connector (shear) portion 30*a* to be manufactured as a solid annular ring. When retainer portion 30*b* is in position, movement of tubulars 20, 30 within housing 18 may be prevented by groove 16. When shear segment 30*a* is sheared from position to release tubulars 20*a*, 20*b* downhole, the outer retainer portions 30*a* remain in position until they dissolve.

Herein, it is both structurally and functionally advantageous that the present apparatus 10 may be configured to have at least one piece inner and outer tubulars 20, 30, and preferably at least multi-piece inner 20*a*, 20*b* and outer tubulars 30*a*, 30*b*. For example, having regard to FIG. 4A, present apparatus 10 may be configured to comprise a fully or partially dissolvable outer tubular 30 having at least one shear segment 30*a* retained within a retaining segment 30*b*, wherein at least a portion of the shear segment 30*a* is securely held within slot 26 between inner tubulars 20*a*, 20*b*, and at least a portion of the retaining segment 30*b* is securely positioned within groove 16 of housing 18. In this manner, when it is desirable to pump the apparatus 10 downhole (e.g., when casing is on bottom), at least a portion of the connector portion (e.g., shear segment) 30*a* may be sheared from the retaining segment 30*b*, resulting in the shear segment 30*a* and both inner tubulars 20*a*, 20*b* to be separated from retaining segment 30*b* and moved downhole. Advantageously, the presently described inner 20*a*, 20*b* and outer tubulars 30*a*, 30*b* ensure that any sheared portions of the apparatus 10 may be cleanly separated from any retained segments held within grooves 26 and 16 when separation of tubulars 20, 30 is triggered.

Figure 4B:
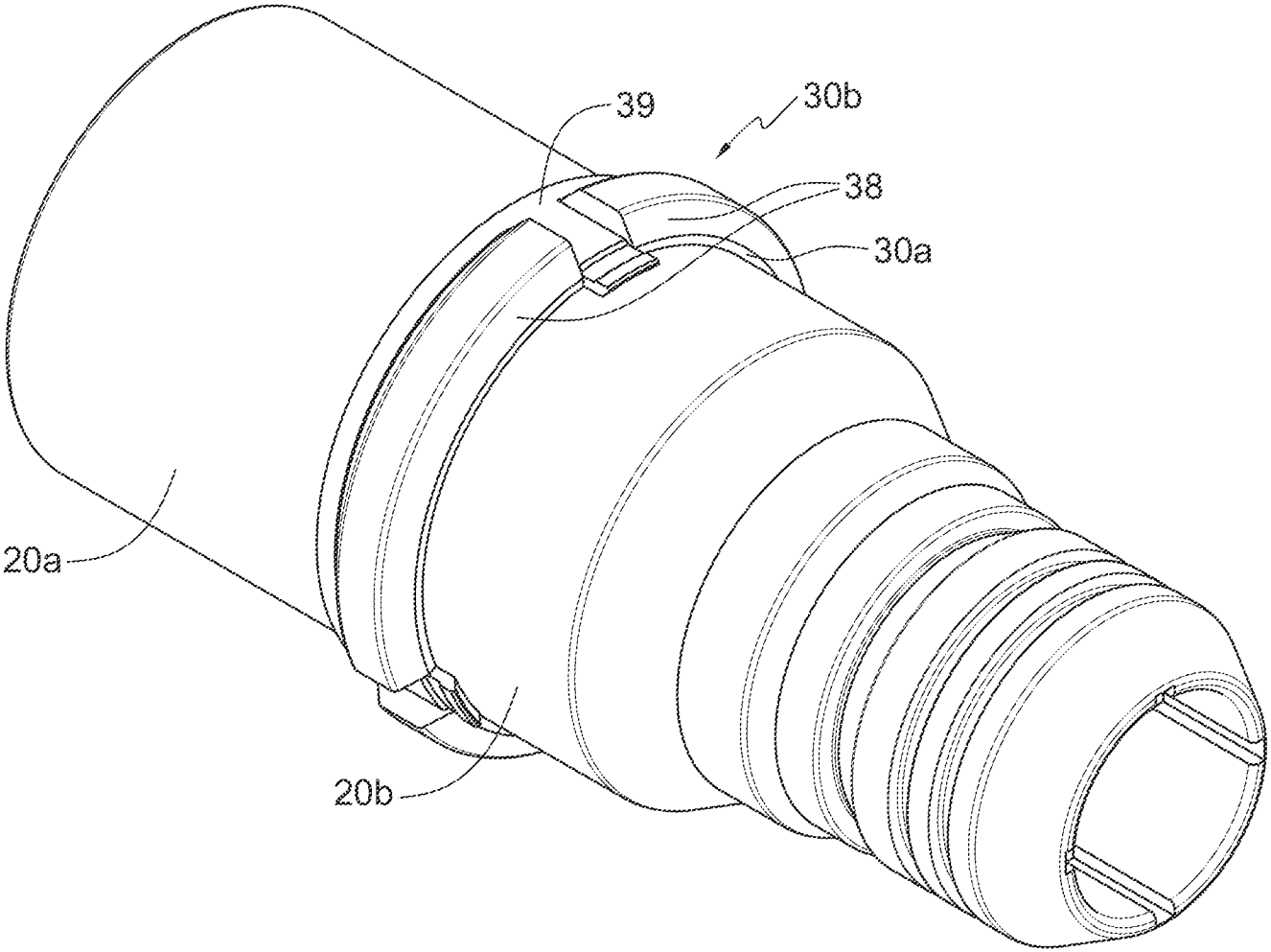
FIG. 4B is a perspective view of the alternative one-piece housing embodiment shown in FIG. 4A, according to embodiments.
Figure 4C:
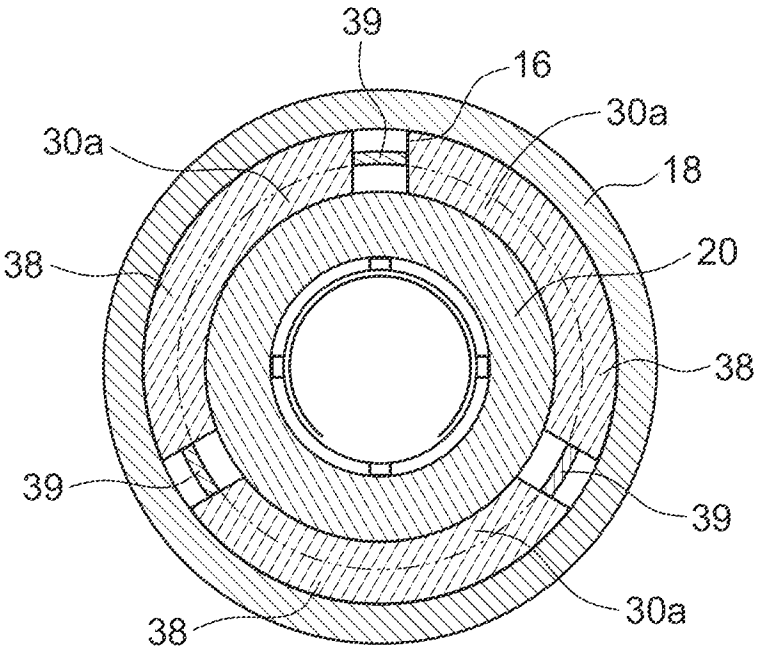
FIG. 4C is a top-down view of the alternative embodiment shown in FIG. 4A (taken along lines D-D), the embodiment shown in a pre-shear view, according to embodiments.
Figure 4D:
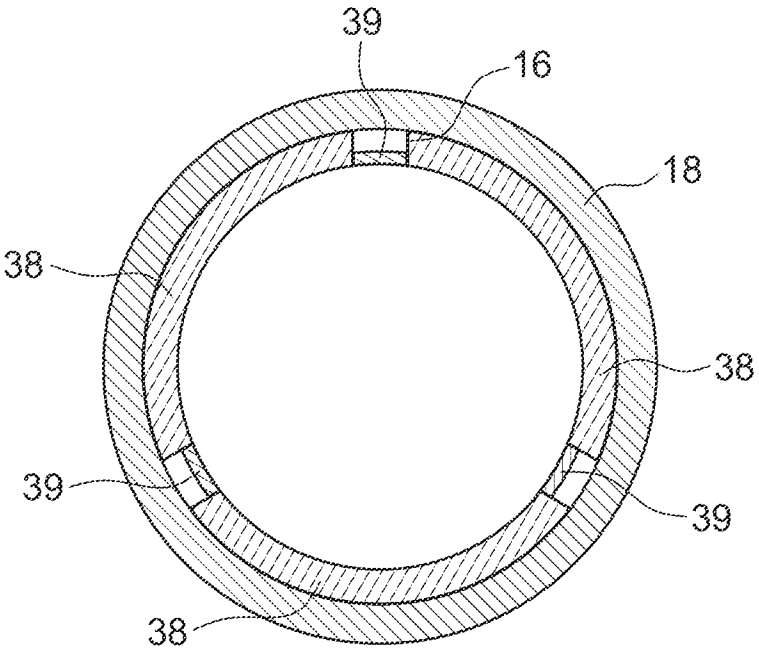
FIG. 4D is the same top-down view of the alternative embodiment shown in FIG. 4C, the embodiment shown in a post-shear view, according to embodiments.
Figure 4F:
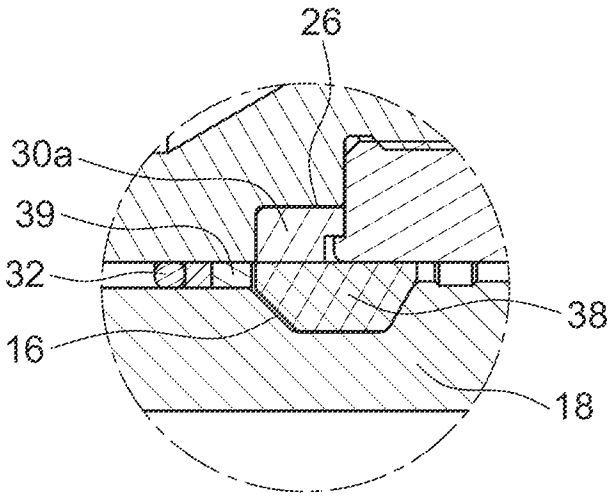
FIG. 4F is a zoomed-in side view of the outer tubular shown in FIG. 4A (circled area B), according to embodiments.
Figure 4E:
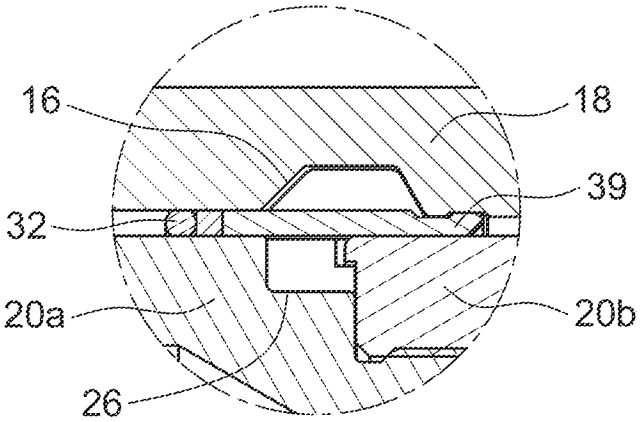
FIG. 4E is a zoomed-in side view of the outer tubular shown in FIG. 4A (circled area A), according to embodiments.
Figure 4H:
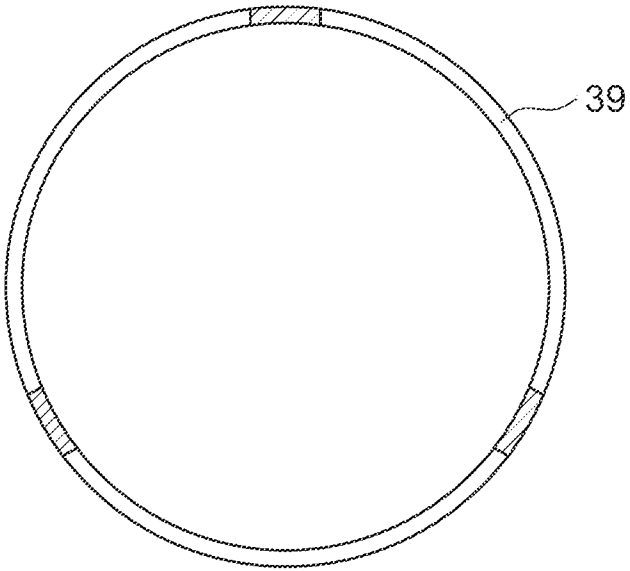
FIGS. 4G and 4H are isolated side and top views, respectively, of a first portion of the outer tubular shown in FIG. 4A, the top view taken along lines (A-A) of FIG. 4G, according to embodiments.
Figure 4G:
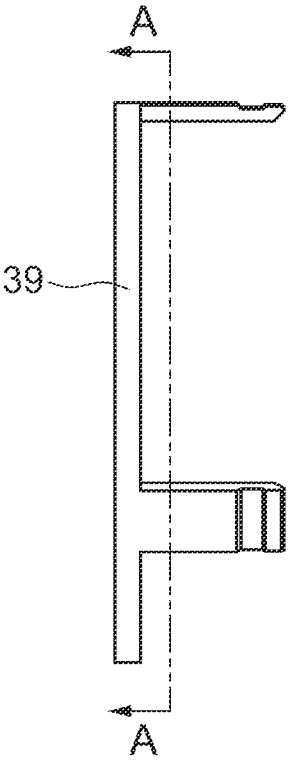
Figure 4J:
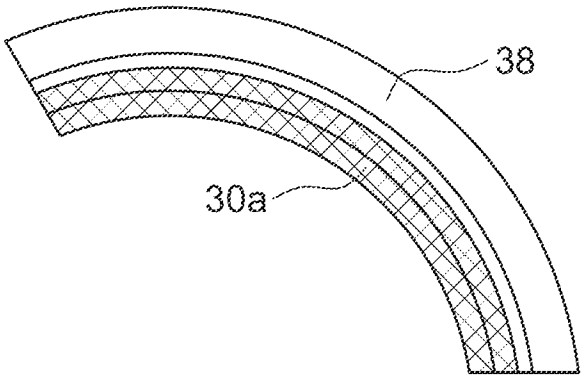
FIGS. 4I and 4J are isolated side and top views, respectively, of a second portion of the outer tubular shown in FIG. 4A, according to embodiments.
Figure 4I:
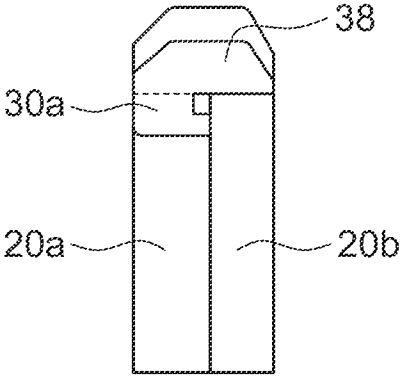

More specifically, having regard to FIGS. 4B and 4C, outer tubulars 30*a*, 30*b* may be disposed about inner tubulars 20*a*, 20*b* and, in some embodiments, retaining segment itself may form a plurality of retainers 38 operably connected to an annular ring 39 (e.g., FIGS. 4G and 4H). Ring 39 may form at least one finger depending therefrom, the fingers serving to bias retainers 38 outwardly into annular groove 16 of housing 18, thereby serving to secure apparatus 10 within housing 18 regardless of the internal diameter of housing (e.g., premium, or semi-premium casing connections). Ring 39 may comprise a solid annular ring, thereby also serving to provide a continuous surface against which at least one annular seal 32 may abut, minimizing seal extrusion and/or failure. Moreover, ring 39 manufactured from dissolvable materials may be readily protected against the harsh wellbore environment using known protective film or viscous fluid coatings, such as petroleum or silicon grease.

Having regard to FIGS. 4C and 4D, when desired, in order to transmit inner tubular 20 downhole, separation of inner and outer tubulars 20, 30 may be triggered by shearing shear segment 30*a*. For example, FIG. 4C provides a top down view of the apparatus 10 in a pre-shear configuration where tubulars 20, 30 are still connected, and FIG. 4D provides the same view in a post-shear configuration where tubulars 20*a*, 20*b* and shear segment 30*a* have been sheared and pumped downhole. As shown in FIG. 4D, retainers 38 and ring 39, which may in part be manufactured of dissolvable materials, may remain in position within groove 16.

Although various shear segments are described herein as examples of mechanical connection means between tubulars 20, 30, it should be understood that any means for releasably securing tubulars 20, 30 together are contemplate particularly where such means can be used to determine or set the shear pressure (e.g., by increasing/decreasing the thickness of outer tubular 30). Embodiments herein may be configured to minimize contract stress between the mechanical connection means and outer tubular 30, providing an apparatus 10 that is more suitable for lower strength materials and/or a one-piece housing 18 (i.e., where tubulars 20, 30 are provided as one integrated tubular). Finally, embodiments herein may also be configured to enable assembly of a two-piece outer tubular 20, allowing for the apparatus 10 to be readily positioned within a single housing 18 for use in LTC and BTC-type threaded casing connections and/or for use in premium and semi-premium threaded housings, as desired.

As above, as desired, the present apparatus 10 may be configured such that the foregoing shearing of the connection between tubulars 20, 30 may occur before or after bursting of rupture disc 52 (described in more detail below). In this manner, in first embodiments, the present apparatus 10 may be used as a casing buoyancy tool until casing on bottom is achieved and then at least one rupture disc may be triggered, reopening the wellbore for cementing operations to begin through bores 25, 35 of the apparatus 10. Once cementing operations are complete, the apparatus 10 is configured to then receive at least one plug, enabling wellbore pressures above the apparatus 10 to be increased so as to trigger the mechanical (shear) mechanism between tubulars 20, 30 and to transmit the apparatus 10 downhole (except for retaining segment 30*b* which remains in place until it dissolves).

In second alternative embodiments, the present apparatus 10 may also be used as a casing buoyancy tool until casing on bottom is achieved and then the mechanical mechanism connecting tubulars 20, 30 may be triggered to pump the apparatus 10 downhole (except for retaining segment 30*b* which remains in place until it dissolves), until the apparatus 10 lands at or near the landing collar. If/when it is desirable to initiate cementing operations, the rupture mechanism may then be triggered to establish circulation.

Advantageously, embodiments of the present apparatus and methods allow the operator to ensure the wellbore is clear prior to commencing cementing operations (or by corroding of the shear ring for fracing operations), the clearing being controllably managed by both apparatus 10 passing through wellbore and also by protecting the dissolvable retaining segment 30*b*, which may only be exposed to air prior to shearing (even where a protective grease or film may be used). Embodiments of the present apparatus and method also eliminate hydrostatic pressure-related complications during cementing operations due to varying cement densities and other problems related thereto (e.g., because, rather than cement, there is water both above and below the apparatus 10).

Moreover, embodiments of the present apparatus and method may use a smaller variation in disconnection (shear) pressure between the shear mechanism and the rupture mechanism, where hydrostatic pressures of water rather than cement can be used to determine/calculate shear rating. As a result, lower pressure pumps may be used during operations, e.g., rig pumps may be used rather than cementing pumps.

Figure 6:
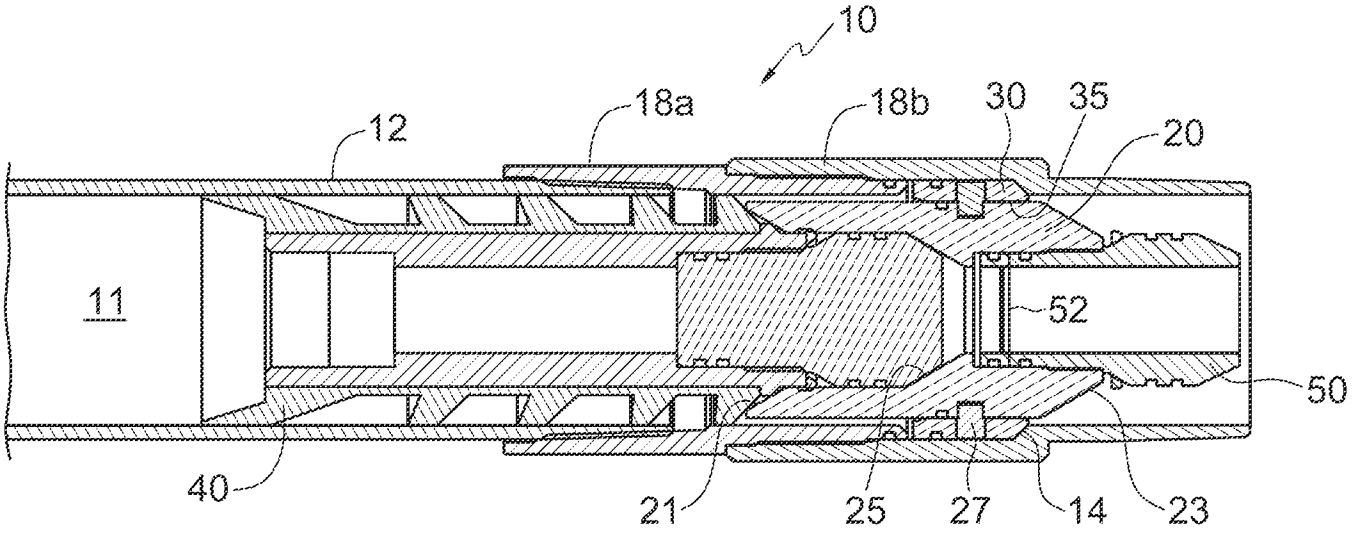
FIG. 6 is a cross-sectional side view of the alternative embodiment of the present apparatus shown in FIG. 3B, the apparatus being operatively connected to one or more plugs, according to embodiments.
Figure 7:
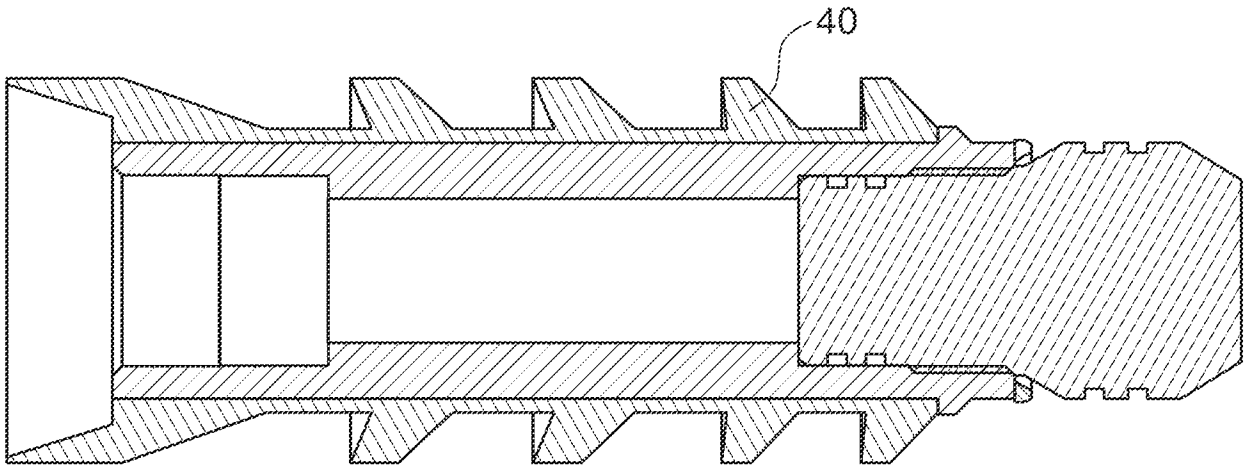
FIG. 7 is an isolated cross-sectional side view of at least one uphole cement plug that may be operably connected with the present apparatus as shown in FIG. 6, the uphole plug being shown as a solid plug, according to embodiments.

According to embodiments, having regard to FIG. 6, apparatus 10 may be configured at its uphole and downhole end for operable connection with at least one uphole and downhole plug(s) 40, 50, respectively. Uphole and downhole plug(s) 40, 50 may be concentrically arranged with apparatus 10, such that plug bores (if applicable) connect with casing bore 11 and tubular bores 25, 35, to form a continuous fluid path through the apparatus 10.

In some embodiments, downhole end 23 of inner tubular 20 may be configured for operable connection with at least one downhole plug(s) 50, such connection being, for example, threaded connection. Downhole plug(s) 50 may be configured so as to temporarily prevent fluid flow through apparatus 10. For example, downhole plug(s) 50 may comprise at least one rupture disc 52 forming a seal within the casing string bore 11 until ruptured. As will be described in more detail, downhole plug(s) 50 may be configured such that the rupture disc 52 requires lower pressures than mechanical connection means (e.g., shear pins 27). In this manner, when desired, disc 52 may be controllably ruptured to open casing bore 11 without releasing apparatus 10 downhole. For example, where mechanical connection means (e.g., shear pins, 27) may be set for burst pressures of approximately 2,500 psi, mechanical connection means may be set for shear pressures of approximately 4,000 psi.

According to embodiments, the at least one downhole plug 50 may further be configured as a latch-in plug, as will be described in more detail.

In some embodiments, uphole end 21 of inner tubular 20 may be configured for operable connection with at least one uphole plug(s) 40, such as a cement plug(s). In some embodiments, uphole end 21 of inner tubular 20 may be configured to receive and latch with the at least one cement plug(s) 40. In some embodiments, the at least one cement plug(s) 40 may form a solid or substantially-solid plug (FIG. 7), while in other embodiments the at least one uphole cement plug(s) 40 may form a hollow or substantially-hollow plug having rupture disc 42 (FIG. 8), or other openable material (such as dissolvable materials).

As would be appreciated, the at least one uphole cement plug 40 may comprise any conventional cement plug serving to displace the cement within the bore 11 of the casing string 12 during cementing operations, where one or more of the plugs may comprise a wiper plug(s). The at least one downhole plug(s) 50 may comprise any conventional latch-in plug, where such conventional plug(s) 50 are capable of seating in standard landing collar or float equipment F therebelow (e.g., see FIG. 10).

The present apparatus and methodologies will now be described in operation.

In operation, to install the casing string 12 into the wellbore W, the string 12 is initially assembled at the surface including the incorporation of at least one embodiment of the present apparatus 10. In a first 'float' use, the apparatus 10 serves to trap low-density fluids, such as air or nitrogen gas, in the casing string 12 below the apparatus 10. For example, having regard to FIG. 2A, the apparatus 10 may be configured with at least one downhole plug 50, said plug comprising a rupture disc 52 for sealing air and creating a buoyant portion of casing string 12 therebelow. As above, the buoyant portion of the casing 12 provides float to counteract friction drag between the string 12 and the walls of the wellbore W. Once the string 12 has been run in hole and landed on bottom, the apparatus 10 will be positioned at or about the heel H of the wellbore W. Where desired, in first embodiments, the bore 11 of the casing string 12 may be opened by rupturing the rupture disc 52 by puncturing the disc or by applying sufficient fluid pressures thereabove. Such operations may be used, for example, to controllably vent the low-density fluid trapped below the apparatus 10 (i.e., controllably opening bore 11 allows air trapped within the lower casing string 12 to be bled off to surface). Alternatively, in other embodiments, but for the retaining segment 30*b*, the apparatus 10 may be sheared from its position and pumped downhole. Such operations may be used, for example, to controllably clear the wellbore W in anticipation of cementing operations, and reducing operational risks related thereto.

In either case, opening bore 11 of the casing string 12 enables cementing operations to begin. In first embodiments, the apparatus 10 may be maintained in position at the heel H of the wellbore W (i.e., without yet releasing apparatus 10 downhole). In such embodiments, once the casing 12 has landed on bottom, fluid pressures from the surface may be applied through string 12 in order to exert enough force on the rupture disc 52, opening bore 11 in preparation for cementing operations, but without shearing the mechanical connection means to release apparatus 10 downhole. In other embodiments, once the casing 12 has landed on bottom, fluid pressures from the surface may be applied through string 12 in order to exert enough force to trigger the shear mechanism, separating tubulars 20, 30 and releasing the apparatus 10 downhole, without rupturing the rupture disc 52.

Advantageously, in either case and as described above, rupturing disc 52 results in the internal diameter of the bore 25 of the inner tubular 20 of the apparatus 10 to be substantially large enough to support cementing flow rates without excessive pressure drop (i.e., <250 psi) or erosion through apparatus 10, or to allow fluids to pumped downhole to establish circulation with the formation. As such, after venting the trapped air from the casing string 12, either a cement slurry or drilling fluids/mud may be introduced into the string 12 and through apparatus 10 without inhibition. Cementing slurry above the apparatus 10 can be circulated through the apparatus 10 and then through a landing collar, float collar (if installed), and float shoe into the annular space between the wellbore W and the casing string 12.

In order to complete the cementing operations when the apparatus 10 remains positioned at the heel H of the wellbore W (or where the apparatus 10 has been sheared from its positioned but has become lodged within the casing bore 11), the at least one uphole cement plug 40 may be lowered from surface and land within upper end 21 of inner tubular 20 of the apparatus 10. For example, in some embodiments, a single plug 40 may be lowered to land in inner tubular 20, the plug 40 operative to latch-in and seal or just to seal within tubular 20. Once in position, pressure above plug 40 can then be increased (e.g., to levels greater than pressures required to burst the disc 52 in downhole plug 50) to pump the entire assembly downhole (i.e., to release the apparatus 10 to the toe T of the wellbore W).

More specifically, having regard to FIG. 10, fluid pressures from a source at the surface can be used to create a pressure differential across the uphole plug(s) 40, said pressure differential being sufficient to trigger the mechanical connection means (i.e., to shear pins 27 from pin holes 26), releasing inner tubular 20 from outer tubular 30, resulting in the inner tubular 20 and both uphole and downhole plugs 40, 50 being lowered downhole. Retainer segment 30*b* of outer tubular 30, which is not released downhole, will remain at or near the heel H of the wellbore W and will dissolve at a pre-determined rate/time. As above, when outer tubular 30 dissolves, the full internal diameter of casing string 12 is regained (see FIG. 9B).

As would be appreciated, the foregoing use of a solid uphole plug 40 will prohibit further fluid from being pumped through the shoe track. However, circumstances may arise where further fluid flow through the toe T of the wellbore is desired or necessary, e.g., a wet shoe. In some cases, it may be desirable to displace the cement out of the shoe track with sugar water, while in others it may be desirable to pump fluid through the shoe track in order to commence fracing operations. In such cases, advantageously, the present apparatus 10 may be configured to receive at least one cement plug(s) 40 having a burst disc or dissolvable materials (e.g., FIG. 8), such that the plug(s) 40 can be controllably opened (e.g., at the onset of frac operations). Where more than one uphole plug 40 is used, at least one first plug(s) 40 may be used to separate cement from sugar water, wherein the volume may be controlled and the plug(s) 40 would prevent mixing of the fluids as the cement is displaced downhole. At least one second plug(s) 40 could then be set to burst as desired (e.g., for fracing operations). Thus, according to some embodiments, apparatus 10 may be used to push cement such as, for example, where the float equipment F downhole has failed. It is thus contemplated that the present apparatus and methodologies may be operative with in a wellbore W having a wet shoe configuration (e.g., Summit 2 rupture system).

Herein, it is contemplated that when apparatus 10 shears from its position at the heel H of the wellbore W, the remaining outer tubular 30 will become exposed to the bore 11 casing string 12 and the fluids/contaminants therein. In some embodiments, outer tubular 30 may thus be manufactured such that portions of the tubular comprise protective coating, film or viscous fluids (e.g., petroleum or silicon grease) preventing said portions from reacting with the fluids/contaminants (and thus controlling the speed at which the tubular 30 dissolves). In this regard, premature dissolving of the outer tubular 30 can be prevented (e.g., during the cementing processes), and can instead be controlled to commence when shearing of the mechanical connection means occurs. Alternatively, where shear mechanism has been triggered prior to cementing operations, the outer tubular 30 can be readily and more controllably dissolved in order to restore the internal diameter of the casing before fluids used in cementing operations are used downhole (e.g., outer tubular 30 may only be exposed to water during casing operations, rather than to more harsh chemicals and/or cement used during cementing operations). According to embodiments, where an atmospheric pressure chamber contained within the air-filled lower section of the casing string 12 is created below the present apparatus 10, there is a higher differential collapse pressure, as compared to conventional operations when fluids are circulated through the entire length of the casing string, resulting in an elevated risk of collapse when the casing 12 is being run in hole. This risk can be exacerbated when drilled cuttings that have not been adequately cleaned from the wellbore build up and surround the exterior of the casing string forming an annular ring that can create a seal, requiring even higher annular circulating pressures at or near the toe CT' of the well and correspondingly increasing the possibility of collapse.

As such, it is contemplated that the present apparatus and methodologies may be used in combination with a casing collapse protection sub 60. In some embodiments, having regard to FIGS. 10 and 11, the protection sub 60 may be installed within the casing string 12, and may be positioned at or near (i.e., coupled with) a shoe track 62. Moreover, having regard to FIG. 14, in some embodiments, at least one modified casing plug 80 having a pump-off nose cone may be provided to further prevent collapse of the casing 12. As would be appreciated, casing plug 80 may also prevent debris from pushing upwards into the shoe track of casing 12, thus protecting the float equipment F. Protection sub 60 may comprise at least one rupture means 64 (e.g., inward facing burst discs) within ports 65, the rupture means 64 set to match casing collapse pressures. In use, if the pressures within the wellbore W exceed the collapse pressure of the casing string 12, the rupture means 64 within protection sub 60 will activate (e.g., blowing inwardly), opening ports 65 to flood the lower casing string 12 and prevent collapse thereof. Although buoyancy of the casing string 12 is lost, the present apparatus 10 may advantageously then be used to open casing bore 11 and to gain circulation to surface. More specifically, disc 52 of the at least one downhole cement plugs 50 may be ruptured to reopen bore 11 of the casing string 12.

As shown in FIG. 13, once circulation has been gained, at least one cement plug(s) 70 (e.g., a wiper plug modified to comprise a long-nose latch 72) having a ruptured at least one rupture disc 74 (now shown in burst condition) may be launched downhole, passing through apparatus 10, so as to land within and latch to protection sub 60 therebelow. In some embodiments, latch 72 may extend into protection sub 60 so as to close ports 65. Once in position, fluids pressures above the at least one cement plug(s) 70 may be increased so as to burst disc 74, reinstating the flow path integrity of the shoe track 62 and enabling casing operations to continue. According to embodiments, the presently improved apparatus provides at least one cement plug(s) (having a rupture disc) operably connected to a tubular receptacle that is 'hung off' a dissolvable insert ring using mechanical shear pins.

Methods herein provide use of the presently improved apparatus to combine float equipment and cement plug functions during casing operations.

Methods are also provided for reducing debris generated within a subterranean wellbore during casing operations (both when the casing is being floated downhole and cemented in place). As would be appreciated, any reduction in the downhole equipment required for casing operations, and debris/contaminant fluids generated therefrom, minimizes risk of failure or surge pressures (e.g., as may arise due to higher than recommended string velocity).

In should also be understood that although it is described herein that the at least one downhole cement plug(s) 40 may be ruptured to open the bore of the casing string before shearing the mechanical securing means to release the apparatus downhole, it is also contemplated that the mechanical securing means may be sheared first, releasing the apparatus from its position and pumping same downhole prior to rupturing the at least one cement plug(s) 40.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

I claim:

1. A method for use during subterranean wellbore operations, the method comprising:

running an apparatus into the wellbore, the apparatus having a substantially cylindrical housing having an uphole end and a downhole end and forming a housing bore, at least one inner tubular, sealingly received within the housing bore, and at least one outer tubular, releasably connected with the at least one inner tubular and sealingly positioned between and interfacing with both the housing and the inner tubular for preventing movement between the housing, the outer tubular, and the inner tubular, wherein at least a portion of the at least one outer tubular comprises at least one connector for controllably releasing the at least one inner tubular, at least another portion of the at least one outer tubular comprises a dissolvable portion for controllably degrading, and at least one disc for controllably restricting fluid flow through the housing bore, the at least one disc configured to restrict flow before releasing the at least one inner tubular in response to a first set of operating parameters and configured to restrict flow after releasing the at least one inner tubular in response to a second set of operating parameters, rupturing the at least one disc restricting fluid flow through the housing bore, triggering the at least one connector portion of the at least one outer tubular to release the at least one inner tubular downhole, and allowing the at least one dissolvable portion of the at least one outer tubular to disintegrate.

2. The method of claim 1, wherein the at least one connector is triggered after the disc for reopening the wellbore during casing operations.

3. The method of claim 1, wherein the at least one connector is triggered by running at least one plug into the wellbore.

4. The method of claim 3, wherein the method further comprises running at least one plug into the wellbore before, after, or at the same time as the apparatus.

5. The method of claim 1, wherein the wellbore operations comprise casing operations, cementing operations, or a combination thereof.

6. The method of claim 1, wherein the apparatus may be slidably received within a central bore of a casing string being run into the wellbore.

7. The method of claim 1, wherein the apparatus may be operably connected to a casing string being run into the wellbore.

* * * * *